US005977923A

United States Patent [19]

Contu et al.

[11] Patent Number: 5,977,923

[45] Date of Patent: Nov. 2, 1999

[54] RECONFIGURABLE, ZOOMABLE, TURNABLE, ELLIPTICAL-BEAM ANTENNA

[75] Inventors: Salvatore Contu; Alberto Meschini; Roberto Mizzoni, all of Rome, Italy

[73] Assignee: Finmeccanica S.p.A., Rome, Italy

[21] Appl. No.: 08/905,379

[22] Filed: Aug. 4, 1997

Related U.S. Application Data

[63] Continuation of application No. 08/682,559, filed as application No. PCT/EP95/01771, May 10, 1995, abandoned.

[30] Foreign Application Priority Data

Nov. 25, 1994 [IT] Italy ..... RM94A0777

[51] Int. Cl.[6] ..... H01Q 19/19

[52] U.S. Cl. ..... 343/761; 343/781 P; 343/839

[58] Field of Search ..... 343/781 P, 761, 343/839; H01Q 19/19

[56] References Cited

U.S. PATENT DOCUMENTS 4,425,566 1/1984 Dragone ..... 343/781

4,755,826 7/1988 Rao ..... 343/781

4,783,664 11/1988 Karikomi et al. ..... 343/781 P

FOREIGN PATENT DOCUMENTS

0284883 A1 10/1988 Germany .

*Primary Examiner*—Michael C. Wimer

*Attorney, Agent, or Firm*—Cohen, Pontani, Lieberman & Pavane

[57] ABSTRACT

A double-reflector microwave antenna of the Gregorian optics family and capable of providing an elliptical beam with a major axis that may be oriented in any desired direction of space by rotation of the sub-reflector about an axis. By adding an additional degree of freedom, that is, an independent translation of the sub-reflector and/or the main reflector along respective axes, a considerable degree of reconfigurability of the shape of the beam may be realized. In particular, the axes of the beam may be widened to vary the ratio between the axes of the elliptical beam for any orientation of the major axis or to obtain a circular beam. The inventive antenna is particularly suitable for use as on board satellites with frequency re-use in an operational environment with one or more simultaneously active beams.

9 Claims, 44 Drawing Sheets

GEOMETRICAL CONDITION TO ELIMINATE REFLECTOR CROSS POLARIZATION:

e=SIN (Bf/2) SIN (Bs+Bf/2)

e=SUB-REFLECTOR ECCENTRICITY

GEOMETRICAL CONDITION TO MINIMIZE REFLECTOR CROSS POLARIZATION:

OPTICAL RAY 14 ≡ FEED AXIS 9

F = 1034 mm
D = 1000 mm
c = 50 mm
d = 500 mm

SUB-REFLECTOR EQUATION $$\frac{x^2}{A^2}+\frac{y^2}{B^2}+\frac{z^2}{C^2}=1$$

A = 570 mm
B = 570 mm
C = 570 mm

LEVELS (DB)

| | |
|---|---|
| 1: 36.56 | 8: 15.56 |
| 2: 33.56 | 9: 12.56 |
| 3: 30.56 | 10: 9.56 |
| 4: 27.56 | 11: 6.56 |
| 5: 24.56 | 12: 3.56 |
| 6: 21.56 | 13: 0.56 |
| 7: 18.56 | |

LEVELS (DB)

| | |
|---|---|
| 1: -33.00 | 8: -40.00 |
| 2: -34.00 | 9: -41.00 |
| 3: -35.00 | 10: -42.00 |
| 4: -36.00 | 11: -43.00 |
| 5: -37.00 | 12: -44.00 |
| 6: -38.00 | 13: -45.00 |
| 7: -39.00 | |

LEVELS (DB)

| | |
|---|---|
| 1: 33.86 | 8: 12.86 |
| 2: 30.86 | 9: 9.86 |
| 3: 27.86 | 10: 6.86 |
| 4: 24.86 | 11: 3.86 |
| 5: 21.86 | 12: 0.86 |
| 6: 18.86 | 13: -2.14 |
| 7: 15.86 | |

LEVELS (DB)

| | |
|---|---|
| 1: -33.00 | 8: -40.00 |
| 2: -34.00 | 9: -41.00 |
| 3: -35.00 | 10: -42.00 |
| 4: -36.00 | 11: -43.00 |
| 5: -37.00 | 12: -44.00 |
| 6: -38.00 | 13: -45.00 |
| 7: -39.00 | |

ELLIPTICAL ROTATING COVERAGE 45 DEG F = 12.75 GHz COPOLAR

LEVELS (DB)

| | |
|---|---|
| 1: 34.28 | 8: 13.28 |
| 2: 31.28 | 9: 10.28 |
| 3: 28.38 | 10: 7.28 |
| 4: 25.28 | 11: 4.28 |
| 5: 22.28 | 12: 1.28 |
| 6: 19.28 | 13: -1.72 |
| 7: 16.28 | |

LEVELS (DB)

| | |
|---|---|
| 1: -33.00 | 8: -40.00 |
| 2: -34.00 | 9: -41.00 |
| 3: -35.00 | 10: -42.00 |
| 4: -36.00 | 11: -43.00 |
| 5: -37.00 | 12: -44.00 |
| 6: -38.00 | 13: -45.00 |
| 7: -39.00 | |

LEVELS (DB)

| | |
|---|---|
| 1: 34.73 | 8: 13.73 |
| 2: 31.73 | 9: 10.73 |
| 3: 28.73 | 10: 7.73 |
| 4: 25.73 | 11: 4.73 |
| 5: 22.73 | 12: 1.73 |
| 6: 19.73 | 13: -1.27 |
| 7: 16.73 | |

LEVELS (DB)

| | |
|---|---|
| 1: -33.00 | 8: -40.00 |
| 2: -34.00 | 9: -41.00 |
| 3: -35.00 | 10: -42.00 |
| 4: -36.00 | 11: -43.00 |
| 5: -37.00 | 12: -44.00 |
| 6: -38.00 | 13: -45.00 |
| 7: -39.00 | |

ELLIPTICAL ZOOMING F = 12.75 GHz SUB DISPLACEMENT ALONG

| LEVELS (DB) | GMN (DB) |
|---|---|
| 1: 33.50 | A: 32.40 |
| 2: 30.50 | |
| 3: 27.50 | |
| 4: 24.50 | |
| 5: 21.50 | |
| 6: 18.50 | |
| 7: 15.50 | |
| 8: 12.50 | |
| 9: 9.50 | |
| 10: 6.50 | |
| 11: 3.50 | |
| 12: 0.50 | |
| 13: -2.50 | |

LEVELS (DB)

| | |
|---|---|
| 1: -33.00 | 8: -40.00 |
| 2: -34.00 | 9: -41.00 |
| 3: -35.00 | 10: -42.00 |
| 4: -36.00 | 11: -43.00 |
| 5: -37.00 | 12: -44.00 |
| 6: -38.00 | 13: -45.00 |
| 7: -39.00 | |

ELLIPTICAL ZOOMING F = 12.75 GHz SUB DISPLACEMENT ALONG

| LEVELS (DB) | GMN (DB) |
|---|---|
| 1: 33.58 | A: 32.40 |
| 2: 30.58 | |
| 3: 27.58 | |
| 4: 24.58 | |
| 5: 21.58 | |
| 6: 18.58 | |
| 7: 15.58 | |
| 8: 12.58 | |
| 9: 9.58 | |
| 10: 6.58 | |
| 11: 3.58 | |
| 12: 0.58 | |
| 13: -2.42 | |

LEVELS (DB)

| | |
|---|---|
| 1: -33.00 | 8: -40.00 |
| 2: -34.00 | 9: -41.00 |
| 3: -35.00 | 10: -42.00 |
| 4: -36.00 | 11: -43.00 |
| 5: -37.00 | 12: -44.00 |
| 6: -38.00 | 13: -45.00 |
| 7: -39.00 | |

ELLIPTICAL ZOOMING F = 12.75 GHz SUB DISPLACEMENT ALONG

| LEVELS (DB) | GMIN (DB) |
|---|---|
| 1: 33.65 | A: 32.60 |
| 2: 30.65 | |
| 3: 27.65 | |
| 4: 24.65 | |
| 5: 21.65 | |
| 6: 18.65 | |
| 7: 15.65 | |
| 8: 12.65 | |
| 9: 9.65 | |
| 10: 6.65 | |
| 11: 3.65 | |
| 12: 0.65 | |
| 13: -2.35 | |

LEVELS (DB)

| | |
|---|---|
| 1: -33.00 | 8: -40.00 |
| 2: -34.00 | 9: -41.00 |
| 3: -35.00 | 10: -42.00 |
| 4: -36.00 | 11: -43.00 |
| 5: -37.00 | 12: -44.00 |
| 6: -38.00 | 13: -45.00 |
| 7: -39.00 | |

| LEVELS (DB) | GMIN (DB) |
|---|---|
| 1: 33.65 | A: 32.60 |
| 2: 30.65 | |
| 3: 27.65 | |
| 4: 24.65 | |
| 5: 21.65 | |
| 6: 18.65 | |
| 7: 15.65 | |
| 8: 12.65 | |
| 9: 9.65 | |
| 10: 6.65 | |
| 11: 3.65 | |
| 12: 0.65 | |
| 13: -2.35 | |

LEVELS (DB)

| | |
|---|---|
| 1: -33.00 | 8: -40.00 |
| 2: -34.00 | 9: -41.00 |
| 3: -35.00 | 10: -42.00 |
| 4: -36.00 | 11: -43.00 |
| 5: -37.00 | 12: -44.00 |
| 6: -38.00 | 13: -45.00 |
| 7: -39.00 | |

| LEVELS (DB) | GMIN (DB) |
|---|---|
| 1: 33.68 | A: 32.75 |
| 2: 30.68 | |
| 3: 27.68 | |
| 4: 24.68 | |
| 5: 21.68 | |
| 6: 18.68 | |
| 7: 15.68 | |
| 8: 12.68 | |
| 9: 9.68 | |
| 10: 6.68 | |
| 11: 3.68 | |
| 12: 0.68 | |
| 13: -2.32 | |

LEVELS (DB)

| | |
|---|---|
| 1: -33.00 | 8: -40.00 |
| 2: -34.00 | 9: -41.00 |
| 3: -35.00 | 10: -42.00 |
| 4: -36.00 | 11: -43.00 |
| 5: -37.00 | 12: -44.00 |
| 6: -38.00 | 13: -45.00 |
| 7: -39.00 | |

| LEVELS (DB) | GMIN (DB) |
|---|---|
| 1: 33.71 | A: 33.25 |
| 2: 30.71 | |
| 3: 27.71 | |
| 4: 24.71 | |
| 5: 21.71 | |
| 6: 18.71 | |
| 7: 15.71 | |
| 8: 12.71 | |
| 9: 9.71 | |
| 10: 6.71 | |
| 11: 3.71 | |
| 12: 0.71 | |
| 13: -2.29 | |

LEVELS (DB)

| | | | |
|---|---|---|---|
| 1: | -33.00 | 8: | -40.00 |
| 2: | -34.00 | 9: | -41.00 |
| 3: | -35.00 | 10: | -42.00 |
| 4: | -36.00 | 11: | -43.00 |
| 5: | -37.00 | 12: | -44.00 |
| 6: | -38.00 | 13: | -45.00 |
| 7: | -39.00 | | |

| LEVELS (DB) | GMIN (DB) |
|---|---|
| 1: 33.28 | A: 33.15 |
| 2: 30.28 | |
| 3: 27.28 | |
| 4: 24.28 | |
| 5: 21.28 | |

LEVELS (DB)

| | | | |
|---|---|---|---|
| 1: | -33.00 | 8: | -40.00 |
| 2: | -34.00 | 9: | -41.00 |
| 3: | -35.00 | 10: | -42.00 |
| 4: | -36.00 | 11: | -43.00 |
| 5: | -37.00 | 12: | -44.00 |
| 6: | -38.00 | 13: | -45.00 |
| 7: | -39.00 | | |

| LEVELS (DB) | GMIN (DB) |
|---|---|
| 1: 33.82 | A: 33.40 |
| 2: 30.82 | |
| 3: 27.82 | |
| 4: 24.82 | |
| 5: 21.82 | |

LEVELS (DB)

| | | | |
|---|---|---|---|
| 1: | -33.00 | 8: | -40.00 |
| 2: | -34.00 | 9: | -41.00 |
| 3: | -35.00 | 10: | -42.00 |
| 4: | -36.00 | 11: | -43.00 |
| 5: | -37.00 | 12: | -44.00 |
| 6: | -38.00 | 13: | -45.00 |
| 7: | -39.00 | | |

| LEVELS (DB) | GMIN (DB) |
|---|---|
| 1: 34.40 | A: 34.85 |
| 2: 31.40 | |
| 3: 28.40 | |
| 4: 25.40 | |
| 5: 22.40 | |

LEVELS (DB)

| | | | |
|---|---|---|---|
| 1: | -33.00 | 8: | -40.00 |
| 2: | -34.00 | 9: | -41.00 |
| 3: | -35.00 | 10: | -42.00 |
| 4: | -36.00 | 11: | -43.00 |
| 5: | -37.00 | 12: | -44.00 |
| 6: | -38.00 | 13: | -45.00 |
| 7: | -39.00 | | |

| LEVELS (DB) | |
|---|---|
| 1: | 35.17 |
| 2: | 32.17 |
| 3: | 29.17 |
| 4: | 26.17 |
| 5: | 23.17 |
| 6: | 20.17 |
| 7: | 17.17 |
| 8: | 14.17 |
| 9: | 11.17 |
| 10: | 8.17 |
| 11: | 5.17 |
| 12: | 2.17 |
| 13: | -0.083 |

LEVELS (DB)

| | | | |
|---|---|---|---|
| 1: | -33.00 | 8: | -40.00 |
| 2: | -34.00 | 9: | -41.00 |
| 3: | -35.00 | 10: | -42.00 |
| 4: | -36.00 | 11: | -43.00 |
| 5: | -37.00 | 12: | -44.00 |
| 6: | -38.00 | 13: | -45.00 |
| 7: | -39.00 | | |

LEVELS (DB)

| | | | |
|---|---|---|---|
| 1: | 31.54 | 8: | 10.54 |
| 2: | 28.54 | 9: | 7.54 |
| 3: | 25.54 | 10: | 4.54 |
| 4: | 22.54 | 11: | 1.54 |
| 5: | 19.54 | 12: | -1.46 |
| 6: | 16.54 | 13: | -4.48 |
| 7: | 13.54 | | |

LEVELS (DB)

| | | | |
|---|---|---|---|
| 1: | -33.00 | 8: | -40.00 |
| 2: | -34.00 | 9: | -41.00 |
| 3: | -35.00 | 10: | -42.00 |
| 4: | -36.00 | 11: | -43.00 |
| 5: | -37.00 | 12: | -44.00 |
| 6: | -38.00 | 13: | -45.00 |
| 7: | -39.00 | | |

MAIN OPTICS PARAMETERS:

| | | | |
|---|---|---|---|
| MAIN REFLECTOR APERTURE | D | = | 1.0000 m |
| MAIN REFLECTOR FOCAL LENGTH | F | = | 0.80000 m |
| MAIN REFLECTOR CLEARANCE | ce | = | 0.06897 m |
| SUB-REFLECTOR INTER.FOCI DISTANCE | c | = | 0.23676 m |
| SUB-REFLECTOR ECCENTRICY | e | = | 0.22221 m |
| SUBSTENDED ANGLE BY SUB-REFLECTOR AXIS AND MAIN REFLECTOR AXIS | β | = | 32.716° |
| SUBSTENDED ANGLE BY SUB-REFLECTOR AXIS AND FEED AXIS | βS | = | 49.522° |

| LEVELS (DB) | |
|---|---|
| 1: -3.00 | 9: -21.00 |
| 2: -4.00 | 10: -24.00 |
| 3: -5.00 | 11: -27.00 |
| 4: -6.00 | 12: -30.00 |
| 5: -9.00 | 13: -33.00 |
| 6: -12.00 | 14: -36.00 |
| 7: -15.00 | 15: -39.00 |
| 8: -18.00 | |

GEOSAT :ANG

LEVELS (DB)

| | | | |
|---|---|---|---|
| 1: | -3.00 | 9: | -21.00 |
| 2: | -4.00 | 10: | -24.00 |
| 3: | -5.00 | 11: | -27.00 |
| 4: | -6.00 | 12: | -30.00 |
| 5: | -9.00 | 13: | -33.00 |
| 6: | -12.00 | 14: | -36.00 |
| 7: | -15.00 | 15: | -39.00 |
| 8: | -18.00 | | |

RECONFIGURABLE, ZOOMABLE, TURNABLE, ELLIPTICAL-BEAM ANTENNA

CROSS REFERENCE TO RELATED APPLICATIONS

This is a continuation of U.S. application Ser. No. 08/682,559, filed Oct. 15, 1996,abandoned, which is a National Stage Application of PCT/EP95/01771, filed on May 10, 1995.

BACKGROUND OF THE INVENTION

1. Field of the Invention

The present invention is related to the technical field of microwave antennas and may be used, for example, with reconfigurable antennas for use on artificial satellites or space stations or in ground radar systems. In particular, the invention is directed to a double-reflector microwave antenna belonging to the family of Gregorian antennas which, through the rotation of its sub-reflector and/or the axial movement of the sub-reflector or a main reflector, achieves the rotation of an elliptical beam without substantially any variation to the beam width and polarization and/or reconfigurability of the beam into a circular, expanded ellipse (also referred to herein as "zoom effect") or intermediate ellipse between the original beam and the circular variation of the beam shape. Moreover, by using another sub-reflector profile, the circular beam may be widened (zoom) into another circular beam.

2. Description of the Related Art

Moderate reconfigurability requirements of future antenna systems include the following functions:

(a) re-pointing of the beam;

(b) turning the elliptical beam without rotation of polarization;

(c) zooming of a circular or elliptical beam, that is, broadening of the beam coverage with substantially no variation of the ratio between the ellipse axes and the area x gain product; and (d) converting a circular beam into an elliptical beam, and vice versa, with substantially no variation of the area x gain product.

Of these four functions, only function (a) is generally available for Ku band communication satellite antennas. Functions (b), (c) and (d) are highly desirable and, together with function (a) (and combinations thereof), in principle set only by the capacity of the type of antenna considered to not degrade the quality of service as a consequence of the greater flexibility so assured. The partial implementation of functions (b), (c) and (d), however, should also satisfy the following criteria and result in only:

(I) minimal increase in the dimensions and mass of the antenna;

(II) substantially no movement of large masses;

(III) substantially no movement of the illuminators, which is undesirable in the presence of relatively high power levels;

(IV) substantially no movement of parts internal to the illuminators, which may potentially generate deleterious intermodulation products;

(V) maximum reliability and simplicity and a minimum number of actuators; and (VI) minimum sensitivity to alignment errors and thermal excursions.

Thus, it is desirable to develop an antenna configuration capable of achieving the reconfigurability functions by acting upon system optics and, as far as practicable, avoid substantially all movement of the illumination system or of large masses.

Antennas capable of electrical performance adequate for present requirements for satellite communications are classified as double reflector Gregorian optics. These optics provide relatively high coverage efficiency, relatively low side lobes and, when particular geometric relations are met, relatively high polarization purity with a size and mass suitable for installation on board satellites, as for example Intelsat VIII satellites.

The general geometry of the Gregorian optics family is shown in FIG. 4. The Gregorian optics include a main reflector 3, a sub-reflector 2 and a suitable feed 1. The Gregorian optics comprise the same elements found in the present invention; however, the elements of the present invention are distinguishable in their movement and surface profiles. Typically, the design of classical Gregorian antennas begins from the canonical surfaces. In FIG. 4, sub-reflector 2 is ellipsoidal having two foci 21, 22 and main reflector 3 is parabolic having a focus 8 which coincides with the first focus 21 of the sub-reflector. These surfaces provide extremely low cross-polarization levels when the geometric requirement for maximum purity shown in FIG. 4 is met. This condition is met when eccentricity e of the ellipsoid of sub-reflector 2 satisfies the geometric relation of angles $\beta_f$ and $\beta_s$ shown in FIG. 4. In this figure, $\beta_f$ is the angle between the symmetry axis 9 of the illuminator 1, whose phase center 7 coincides with a second focus 22 of the ellipsoidal sub-reflector 2, and propagation axis Z. Angle $\beta_s$ is the angle between symmetry axis 9 and a rotation axis of symmetry 10 of the sub-reflector surface which intersects through both foci 21, 22 of the ellipsoid. Sub-reflector 2 of FIG. 4 is an ellipsoid obtained by revolution about axis 10, while the optics of the present invention have a sub-reflector surface which cannot be obtained by revolution about the axis crossing points 7 and 8.

The optical system shown in FIG. 4 may be used to generate a circular beam. In addition, the standard optics of FIG. 4 are commonly used to generate an elliptical beam by shaping the sub-reflector surface 2 and/or the main reflector 3 numerically and accepting the electrical degradations in terms of polarization purity which derive from this upset system. These degradations are generally acceptable since the deviations introduced onto the surfaces are relatively small. This optical system clearly cannot, however, provide a rotation of the elliptical beam by turning the sub-reflector.

Presently, there exist no known solutions exist which allow the reconfiguration of the beam in terms of rotation and/or reconfiguration and/or widening (zoom) of the contour of the beam on such types of antennas using a single feed. The only function available today on such antennas is beam repainting, a function that is normally performed through a system of biaxial actuators within a cone of approximately ±11° which represents the useful field of view of the Earth from a geostationary orbiting satellite.

Another class and type of antennas, dual-gridded reflector type optical systems, are commonly used to obtain shaped antenna beams when a reconfigurable contour and relatively high polarization purity is required. This type of system includes two feed arrays located in the focal plane of the optical system, a rear reflector and a front reflector. As shown in FIGS. 27*a* through 27*c*, the front reflector is implemented by application of linear metal strips onto the dielectric surface of the front shell and the back reflector may be either solid or gridded with strips arranged orthogonal to those of the front reflector. In particular, FIGS. 27*a*,

27*b* and 27*c* show front, top and side elevational views, respectively, of the dual-gridded reflector type optical system. As shown in these figures, a group of feeds 1 provides polarization of the electrical field along the X axis and a corresponding group of illuminators 1' provides polarization along the Y axis. The optical system also includes a gridded front reflector 3 that is sensitive to X polarization and a rear reflector 3', which may be either solid or gridded, that is sensitive to Y polarization.

The characteristics of this optical system are such that each reflector operates in single polarization mode and benefits by the space filtering effect of the other reflector on the cross-polarization components that would otherwise be radiated over the service coverage. The radiating elements are typically excited by a beam forming network which includes microwave components capable of changing the excitation of the radiating elements placed in the focal plane through power dividers and/or phase shifters. This technique is based on reconfigurable feed arrays that belong to another class of antenna families. The present invention, however, is directed to reconfigurable single feed antennas that are extremely simple, lightweight and capable of exploiting the optics degree of freedom to improve electrical performance relative to multifeed antennas having the same main reflector aperture, a functionality not provided by the prior art.

SUMMARY OF THE INVENTION

The present invention provides an antenna configuration capable of rotating an elliptical beam with substantially constant beam width or variable contour and electrical radiating characteristics which are typical of the double offset reflector of the Gregorian type, that is, relatively highly antenna lobe efficiency and relatively low cross-polarization and sidelobes. These characteristics are essential for on board communication satellite antennas with dual polarization capability in an operational environment having more than one simultaneously active beam.

The inventive antenna is an improvement over conventional Gregorian antennas. Movements to achieve reconfigurability, that is, rotation of the sub-reflector and/or translation of the main reflector and/or of the sub-reflector, have never before been suggested or implemented because classical Gregorian optics do not permit rotation of the sub-reflector.

Moreover, the profiles of the surfaces and the method through which such surfaces are shaped allow rotation of the beam while maintaining substantially constant electrical radiating characteristics of the co-polar and cross-polar components by simple rotation of the sub-reflector. In addition, the orientation of the electrical field is substantially unchanged during rotation which is an essential characteristic for the use of an antenna in an operational environment which includes a number of simultaneous beams.

An additional improvement of this invention over previously known antennas is its ability to combine rotation of the sub-reflector with additional motion, namely, translation of the sub-reflector and/or main reflector, along predetermined axes so as to provide substantial reconfiguring capability of the starting elliptical beam for any desired orientation of the beam with an efficiency, polarization purity and sidelobes that are comparable to those of a fixed beam Gregorian type antenna. In particular, with this movement the ratio of the main axes of the elliptical beam may be progressively or continuously varied for any orientation of the axes or to obtain an elliptical coverage shaped gradually into that of a circular beam.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views.

DETAILED DESCRIPTION OF THE PREFERRED EMBODIMENTS

Figure 1:
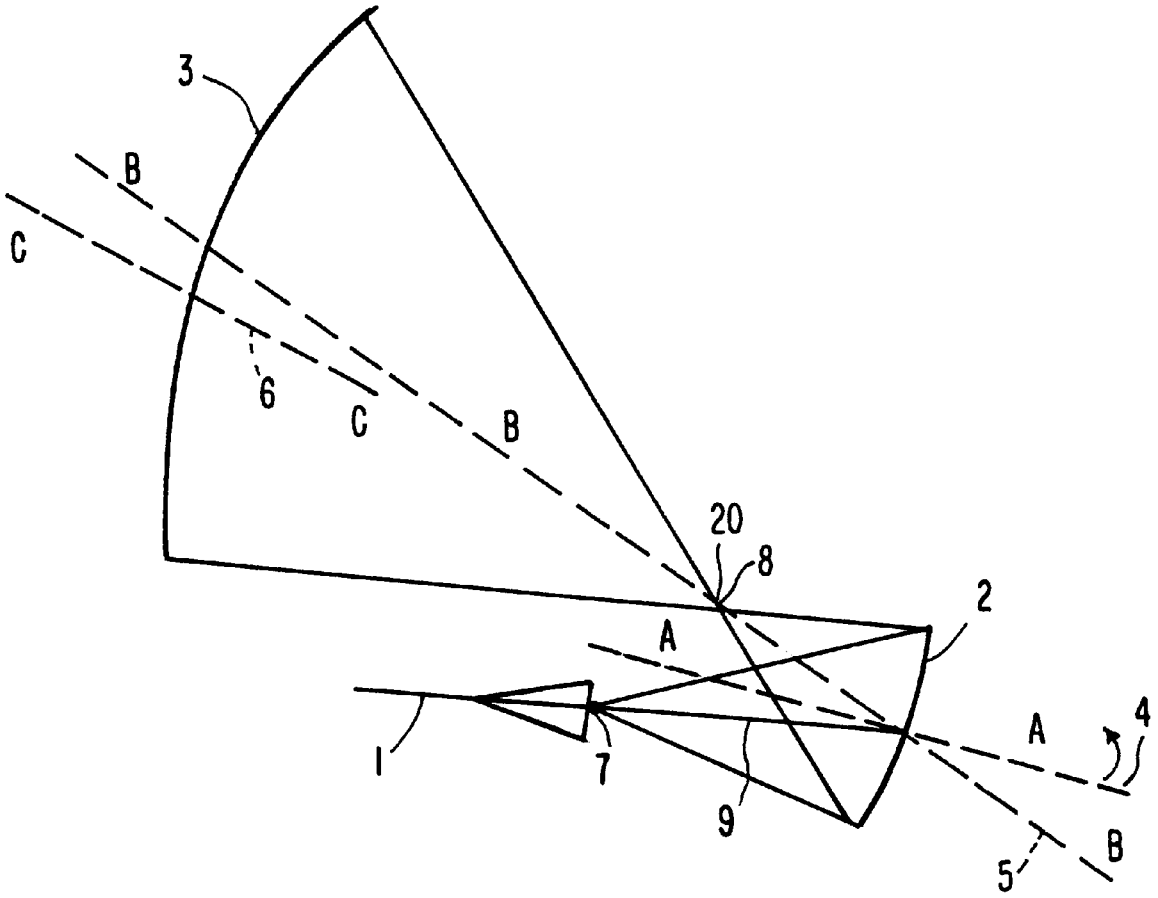
FIG. 1 is a schematic diagram of an optical system in accordance with the present invention.
Figure 2A:
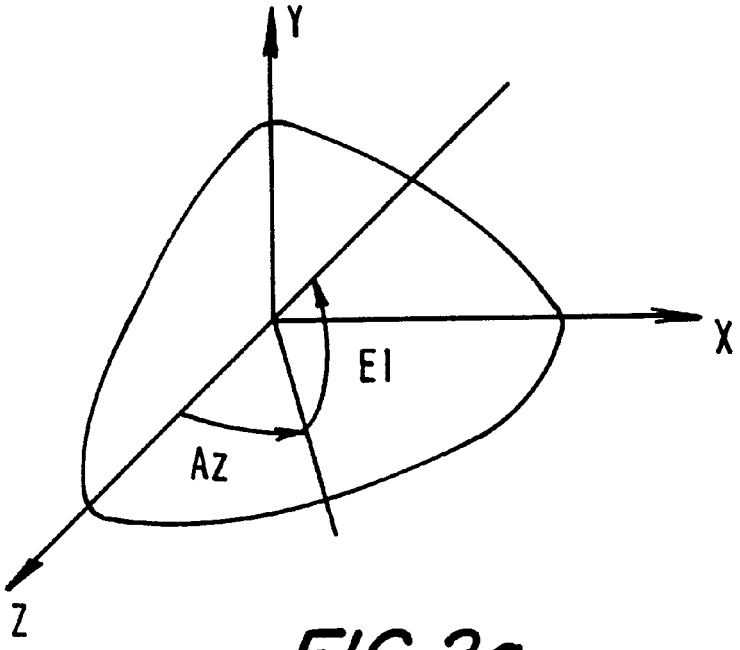
FIG. 2*a* depicts a Cartesian axis tern showing the angle coordinates azimuth (Az) and elevation (El) of a generic observation direction.
Figure 2B:
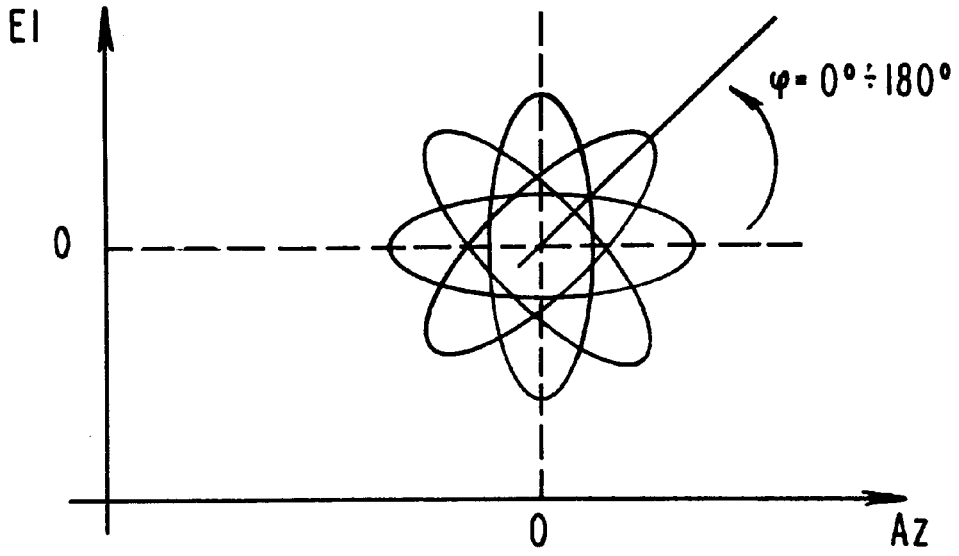
FIG. 2*b* is a graphical representation of the possible orientations on the azimuth-elevation plane of an elliptical beam.
Figure 3A:
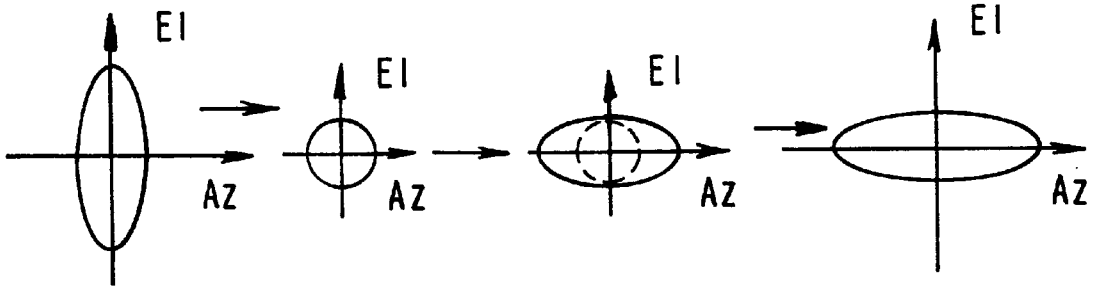
FIG. 3*a* depicts a schematic reconfiguration of an elliptical beam into a circular beam and back into an elliptical beam.
Figure 3B:
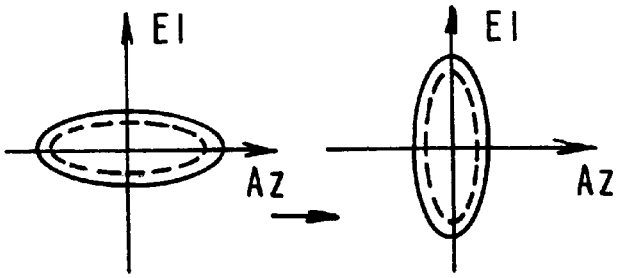
FIG. 3*b* shows a schematic outline of the zoom effect on an elliptical beam.
Figure 3C:
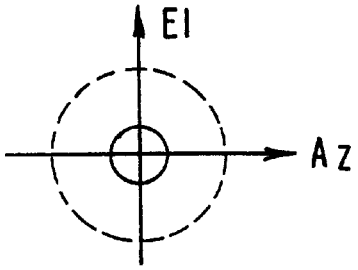
FIG. 3*c* shows a schematic outline of the zoom effect on a circular beam.

An optical system constructed in accordance with the present invention is shown in FIG. 1. The antenna optics include a feed 1 with adequate primary radiation characteristics, that is, a rotational symmetry pattern and relatively low level of cross-polarization, and a center of phase 7. In addition, the optics include a shaped sub-reflector 2 with a surface having two orthogonal symmetry planes, shown in FIG. 6 as planes 17 and 18, which cross along a rotation axis 4 (axis A—A). Rotation axis 4 bisects the angle between symmetry axis 9 of feed 1 and an offset axis 5 (axis B—B) of a suitably shaped main reflector 3. A caustic point or pseudo focus 20 is the point at which the rays from feed 1 converge after being reflected by sub-reflector 2 and which coincides with a focus 8 of main reflector 3. Rotation of the elliptical beam, as shown in FIGS. 2*a* and 2*b*, is realized by rotating the sub-reflector 2 around rotation axis 4 (axis A—A). Sub-reflector 2 may also be translated along axis 5 (axis B—B) whereby the elliptical beam may be reconfigured by combining rotational and translational movement, as shown in FIGS. 3*a*, 3*b*. In a preferred embodiment, as an alternative to translation of the sub-reflector along axis 5, the antenna beam may be reconfigured by translation of the main reflector 3 along axis 6 (axis C—C). In this embodiment, the axes 5 and 6 may coincide with the offset axis 4 (axis A—A) of the main reflector, but typically do not.

Three independent motors may be used to achieve all movement of rotation of the elliptical beam, the zoom of the same elliptical beam into a wider beam and/or the reconfiguration of the antenna beam into an elliptical beam with a major axis that may be gradually shortened to achieve a circular beam. Alternatively, reconfiguration may be realized through only two movements, but with different excursion limits for surface translation and with similar but not identical performance.

Figure 5:
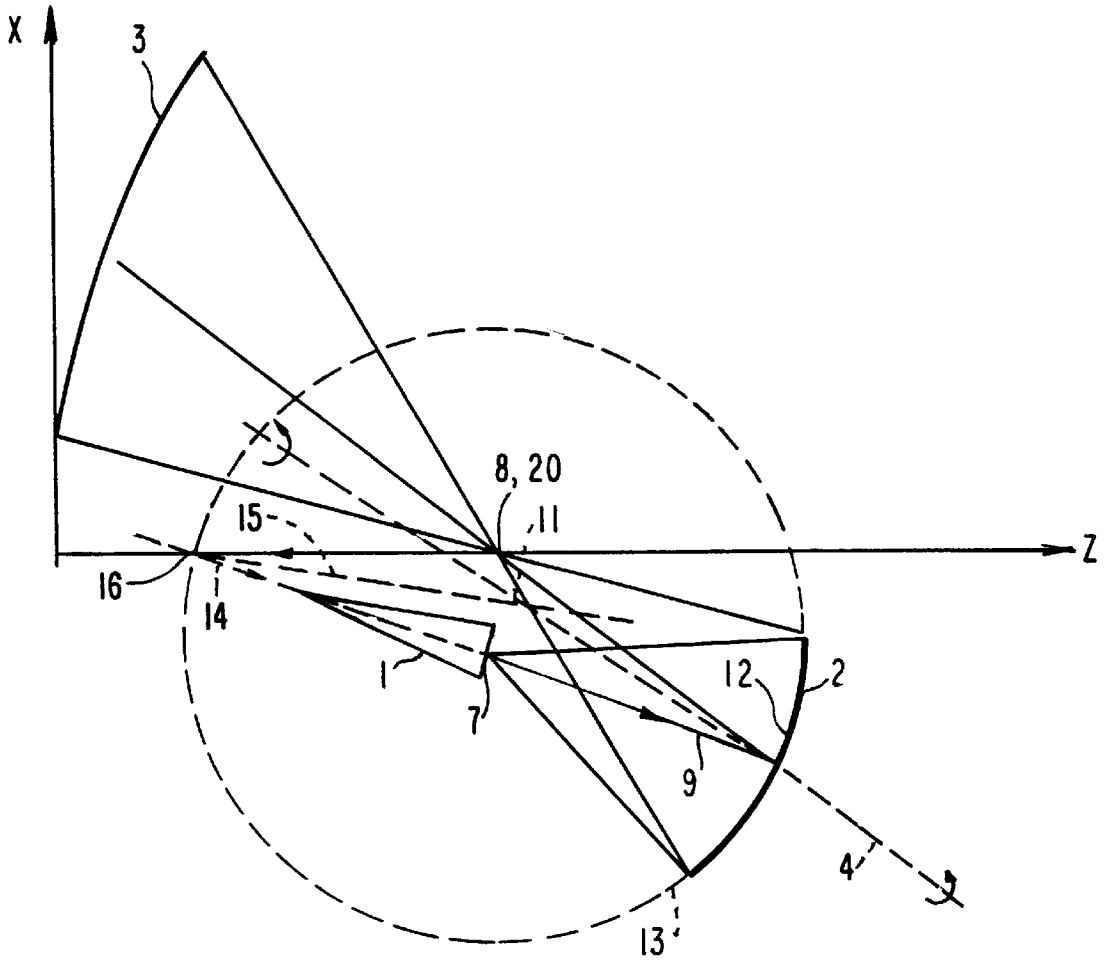
FIG. 5 is a schematic diagram of the present inventive optical system showing the starting geometry of the sub-reflector and the maximum polarization purity condition on the antenna symmetry plane.

The inventive optical system is based on a relatively simple configuration. The starting geometry or configuration, as shown in FIG. 5, has the phase center 7 of illuminator 1 suitably displaced with respect to a center 11 of sphere 13 generated by spherical sub-reflector 2. The symmetry axis 9 of feed 1 is oriented to assure optimum polarization purity characteristics to the optical system, that is the geometrical condition to minimize reflector cross-polarization. Maximum polarization purity occurs when symmetry axis 9 coincides with an optical ray 14 reflected at intersection 16 of the Z axis and sphere 13 for a source ray coming from infinity in an axial direction −Z. In particular, axis Z must form an angle with the perpendicular 15 to the sphere 13 at point 16 approximately equal to that formed by the axis of feed 1 with the perpendicular 15. The scanning properties of a spherical surface are such as to collimate the rays of the feed 1 placed outside the center 7 of the sphere, at approximately a caustic locus or pseudo focus 20, which coincides with focus 8 of the main parabolic reflector 3. Thus, through suitable selection of the optics parameters a slightly aberrated system is realized with the result of a substantially circular symmetrical radiation pattern at a secondary level. In order to recover the residual aberrations of the optics due to the spherical sub-reflector 2, main reflector 3 is suitably shaped to achieve a perfectly focused and symmetrical circular beam as the main reflector output. By rotating spherical sub-reflector 2 around sub-reflector rotation axis 4, which passes through the center 11 of sphere 13 and through the intersection 12 of axis 9 of feed 1 with the surface of spherical sub-reflector 2, an invariant secondary radiation pattern will result since nothing has changed from a geometrical viewpoint.

Figure 6:
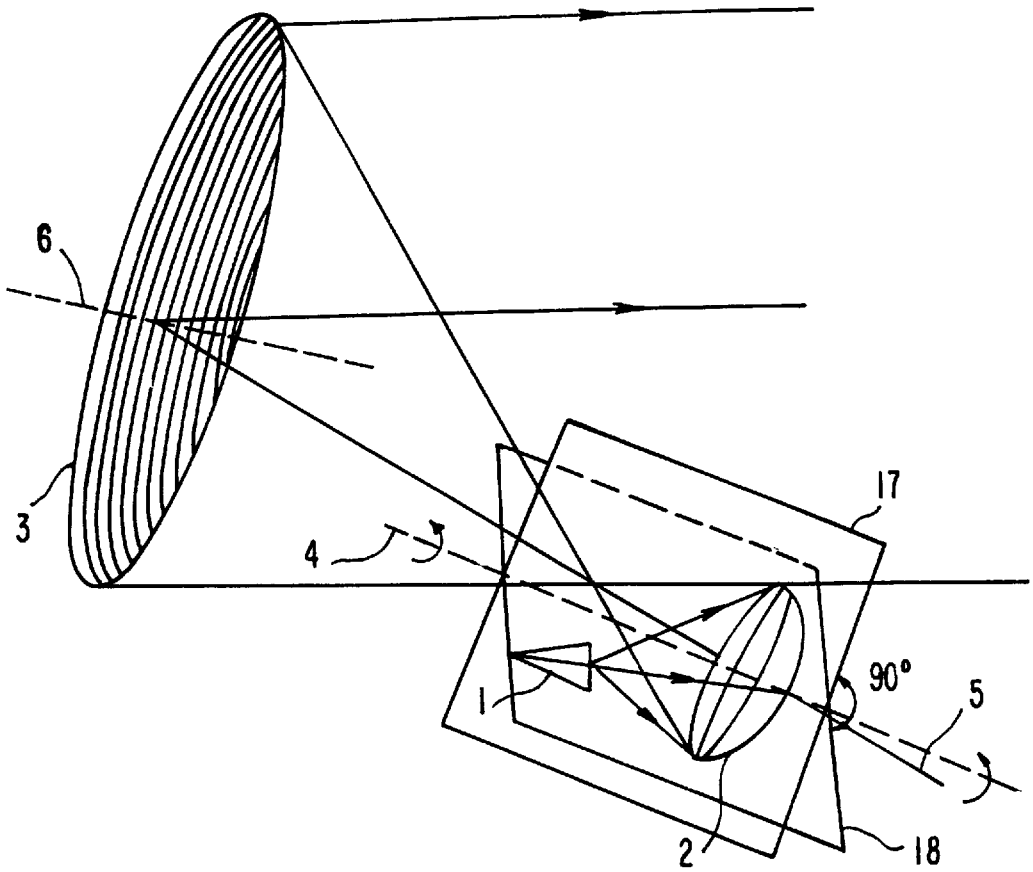
FIG. 6 shows a schematic diagram of the final geometry of an optical system in accordance with the present invention and specifically highlights the main planes of symmetry of the sub-reflector.

The next step is to suitably shape the sub-reflector spherical surface so as to generate the required asymmetry in the secondary radiation pattern. In FIG. 6, which shows the same optical system of FIG. 5, the shaping of sub-reflector 2 is realized by maintaining the symmetry of the reflecting sub-reflector surface with respect to main planes 17 and 18. Planes 17 and 18 are perpendicular to one another and intersect along rotation axis 4 of sub-reflector 2. Arrangement of planes 17 and 18 in this manner substantially assures that, for any arbitrary rotation of sub-reflector 2 with respect to its original rotational symmetry axis 4, an equal rotation of the secondary radiation pattern of the antenna occurs. Reconfiguration and zoom functions of the beam may also be assured by translation of sub-reflector 2 along axis 5 or by translation of the main reflector 3 along axis 6 which actually coincides with the offset angle of the main reflector. Shaping of sub-reflector 2 is generally effected numerically while maintaining the symmetry of the sub-reflector with respect to the symmetry planes 17 and 18 as shown in FIG. 6.

Figure 7A:
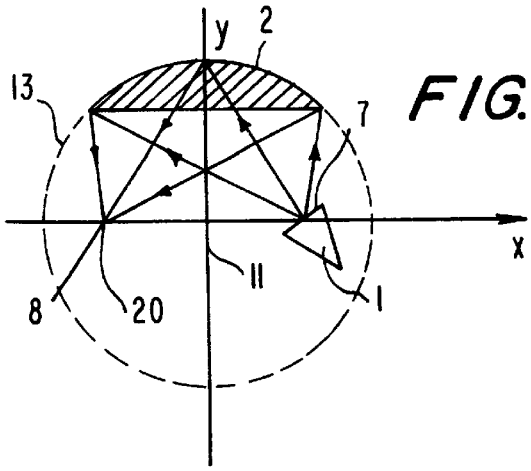
FIG. 7*a* shows a spherical sub-reflector profile.

In order to better highlight the relatively high number of possibilities, the various possible profiles of the sub-reflector are best represented analytically and in a qualitative manner as shown in FIG. 7. In particular, FIG. 7*a* reproduces the geometrics involved in the starting spherical sub-reflector previously shown in FIG. 5. In FIG. 7*a*, the phase center 7 of feed 1 is displaced with respect to the center 11 of geometric extension sphere 13 to which spherical sub-reflector 2 belongs. After being reflected by sub-reflector 2, the rays are collimated at point 20 which coincides with the focus 8 of main reflector 3.

Figure 7B:
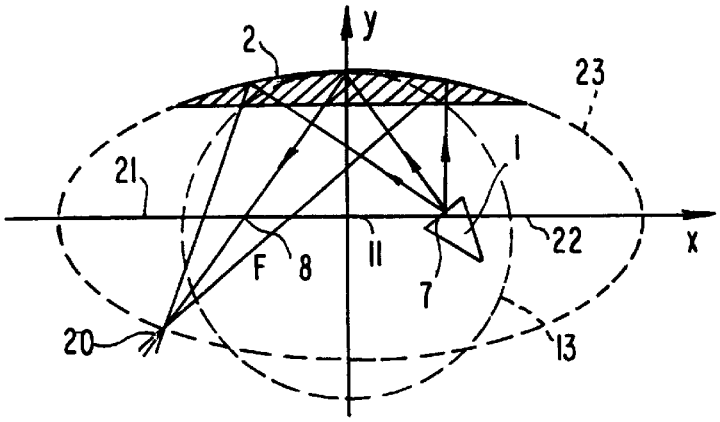
FIG. 7*b* shows an elliptical sub-reflector profile with a curvature in the antenna symmetry plane which is larger than the initial spherical sub-reflector of FIG. 7*a*.
Figure 7C:
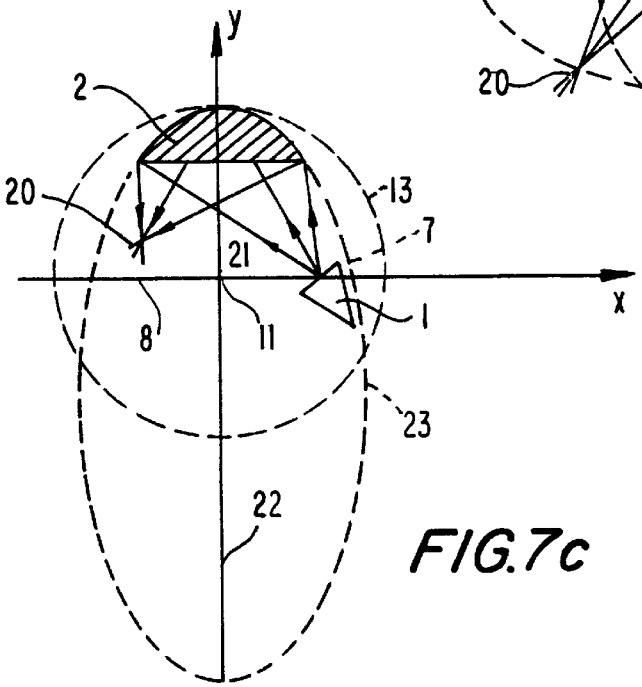
FIG. 7*c* shows an elliptical sub-reflector profile with a curvature in the antenna symmetry plane which is smaller than the initial spherical sub-reflector of FIG. 7*a*.

FIGS. 7*b* and 7*c* show how the initially spherical section of the sub-reflector 2 may be analytically shaped so as to obtain two different types of elliptical profiles. In particular, FIG. 7*b* shows the case in which sub-reflector 2, initially in the shape of sphere 13, is transformed into an elliptical profile 23 with a curvature radius greater than that of the spherical sub-reflector 2. The rays leaving the phase center 7 of feed 1, after being reflected by the elliptical sub-reflector 2 with foci 21 and 22, converge at point 20 (which differs from point 8) so as to achieve the required asymmetrical illumination of the main reflector which maintains its focus at point 8. On the other hand, FIG. 7*c* shows the case of sub-reflector 2 with elliptical profile having a curvature of radius shorter than that of the initial sphere 13. Rays leaving the phase center 7 of feed 1, after being reflected by sub-reflector 2, are collimated at point 20 which is in this embodiment is closer to the surface of the sub-reflector 2.

Referring now to FIG. 6, since the shape of the sub-reflector 2 may be different along the two main planes 17 and 18, according to the profile types shown in FIGS. 7*b* and 7*c*, the asymmetry generated at sub-reflector level may be exploited to generate the required elliptical beam after being reflected by the main reflector. The three different possibilities which may arise cover analytically the main types of shaping for elliptical and circular coverages.

Illustrative examples obtained through analytical shaping of only the sub-reflector show the typical performance and functions of reconfiguration which may be achieved following each movement. The results shown may be substantially improved since the geometric parameters of the optics have not been subjected to a fine optimization procedure and the surface profiles have not been used to their best.

Two examples are provided. The first shows rotation, zoom and reconfiguration capabilities of an elliptical beam. The second example demonstrates the zoom capability of the circular beam.

I. EXAMPLE 1

Rotation, Zoom and Reconfigurability Functions of An Elliptical Beam

The first example showing rotation, zoom and reconfigurability of an elliptical beam will now be described. For purposes of illustration only, in this example the frequency is 12.75 GHz.

Figure 8:
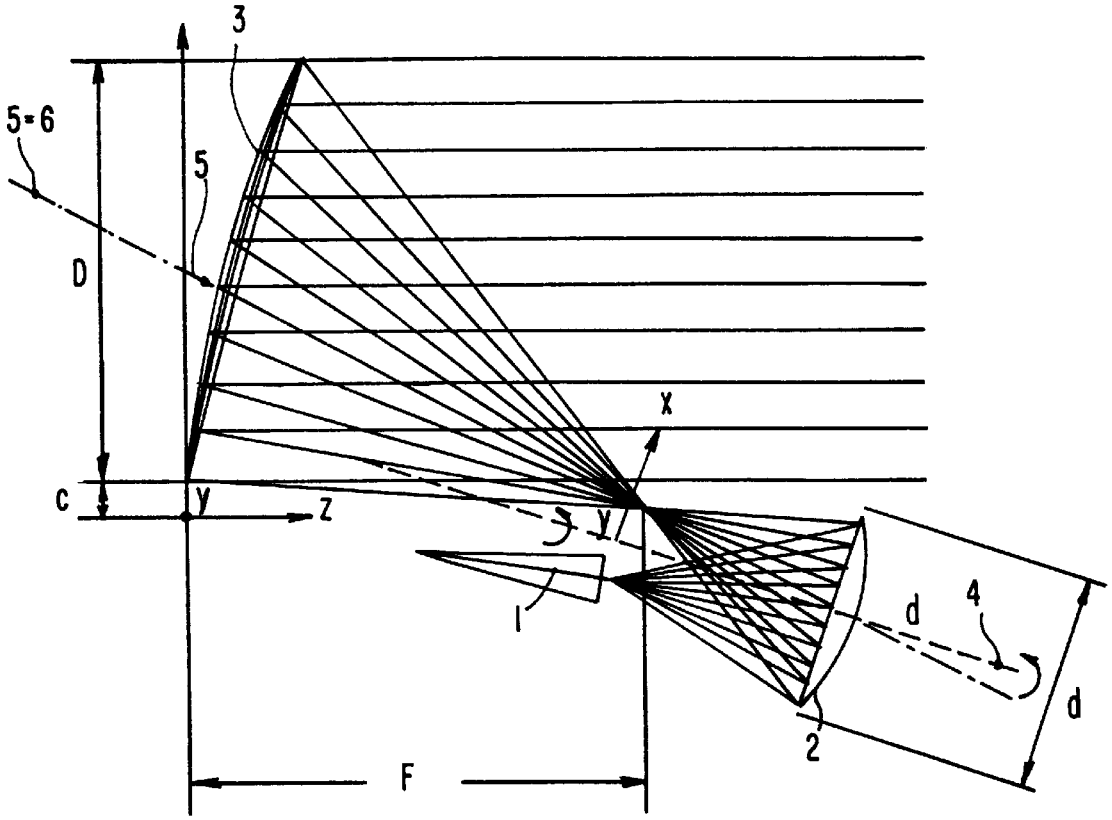
FIG. 8 shows a schematic diagram of the initial geometry of the optical system used for Examples 1 and 2 to illustrate rotation and reconfiguration capabilities of an elliptical beam and zoom capability of a circular beam.

FIG. 8 shows the initial geometry of an optical system which is the same as that depicted in FIGS. 1 and 6. The optical system of FIG. 8 includes a feed 1, sub-reflector 2, parabolic main reflector 3, sub-reflector rotation axis 4 and main or sub-reflector translation axes 5,6 which, in the example, are coincident. Main reflector 3 has a focal length F. D represents the diameter projected along the propagation direction of main reflector 3. The distance C is from the vertex of the main reflector 3 to the lower edge of the reflector itself. Sub-reflector 2 has a diameter D.

Figure 9A:
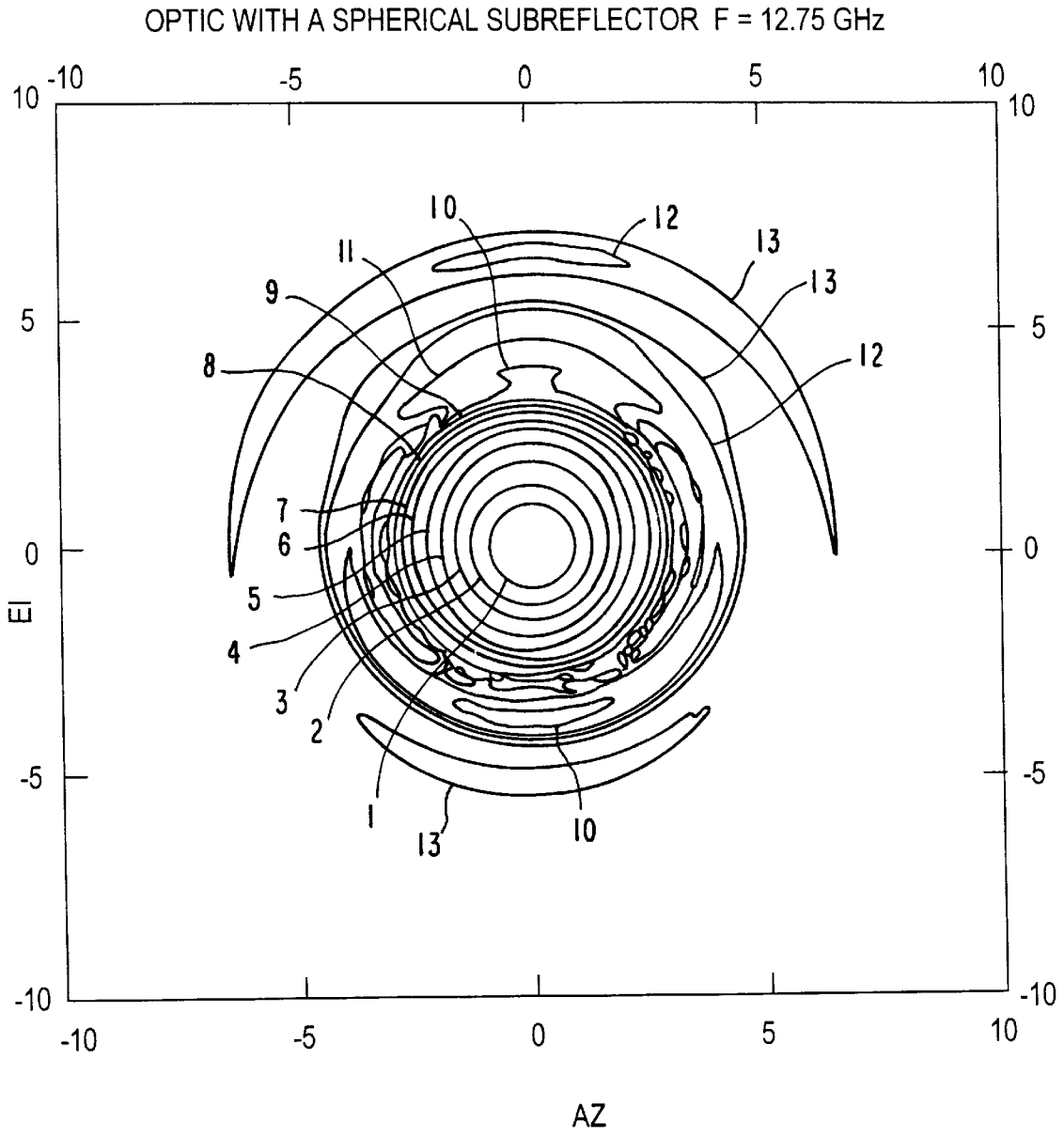
FIG. 9*a* shows a co-polar radiation pattern of the antenna of FIG. 8 with the initial spherical sub-reflector profile showing isolevels in dB with respect to the isotropic value.
Figure 9B:
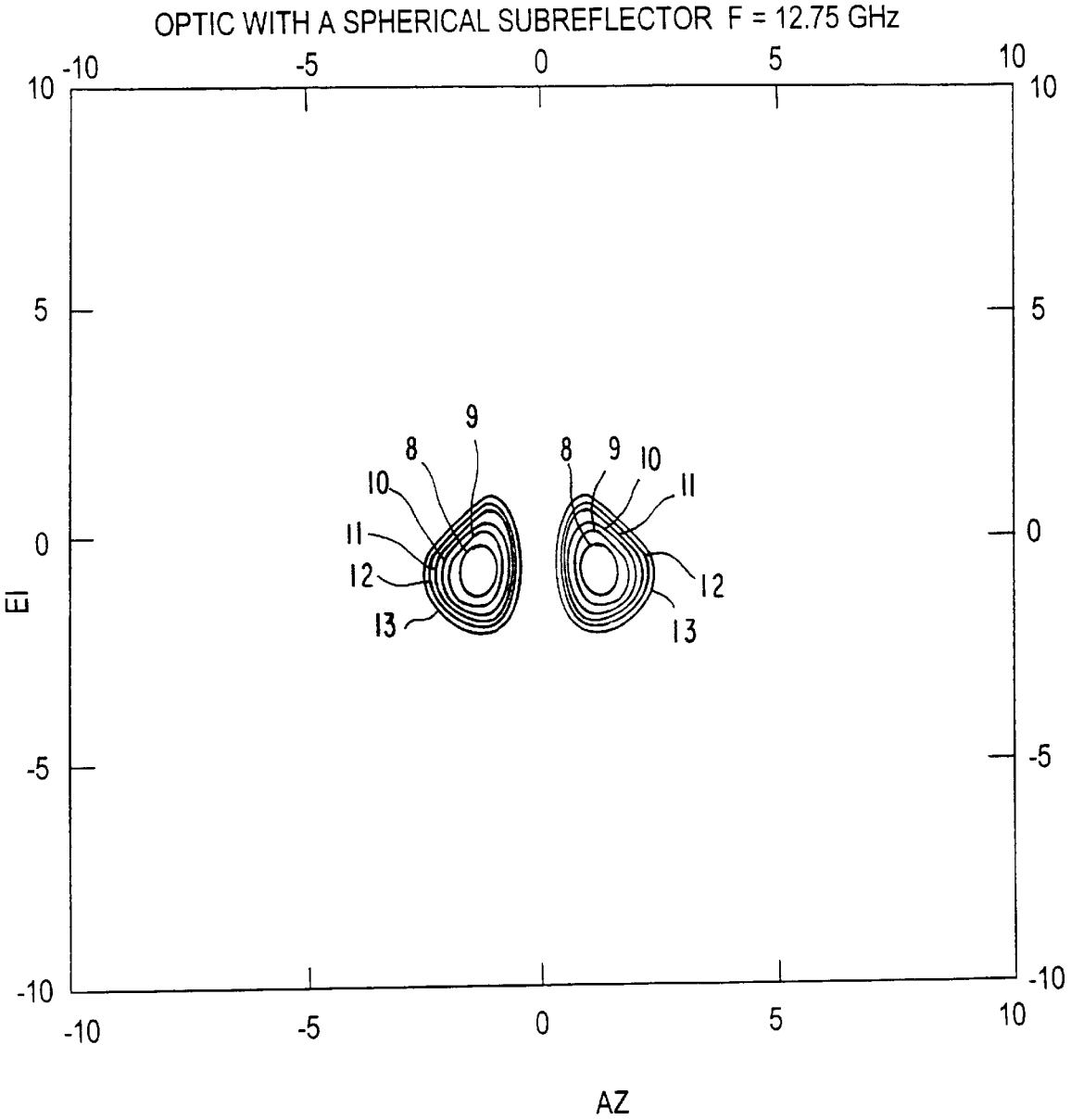
FIG. 9*b* shows a cross-polar radiation pattern of the antenna of FIG. 8 with the initial spherical sub-reflector profile showing isolevels in dB with respect to the isotropic value.

The radiation pattern of the co-polar component obtained at secondary level is shown in FIG. 9*a* in terms of isolevel in dBi related to the isotropic value. The corresponding radiation pattern of the cross-polar component is shown in FIG. 9*b* in terms of isolevels in dB normalized to the peak value of the co-polar diagram. As is evident from these figures the co-polar beam maintains a quasi-circular symmetry (without shaping of the main reflector) and a relatively low value of cross-polarization, less than −37 dB compared to the peak of the co-polar, corresponding to the initial optical system.

A. Elliptical Beam Rotation Function

Referring to FIG. 8, the surface of the sub-reflector is shaped analytically using the sub-reflector equation $$\frac{x^2}{A^2}+\frac{y^2}{B^2}+\frac{z^2}{C^2}=1 \tag{1}$$

where A=570 mm, B=640 mm, C=570 mm, for this example.

Figure 10A:
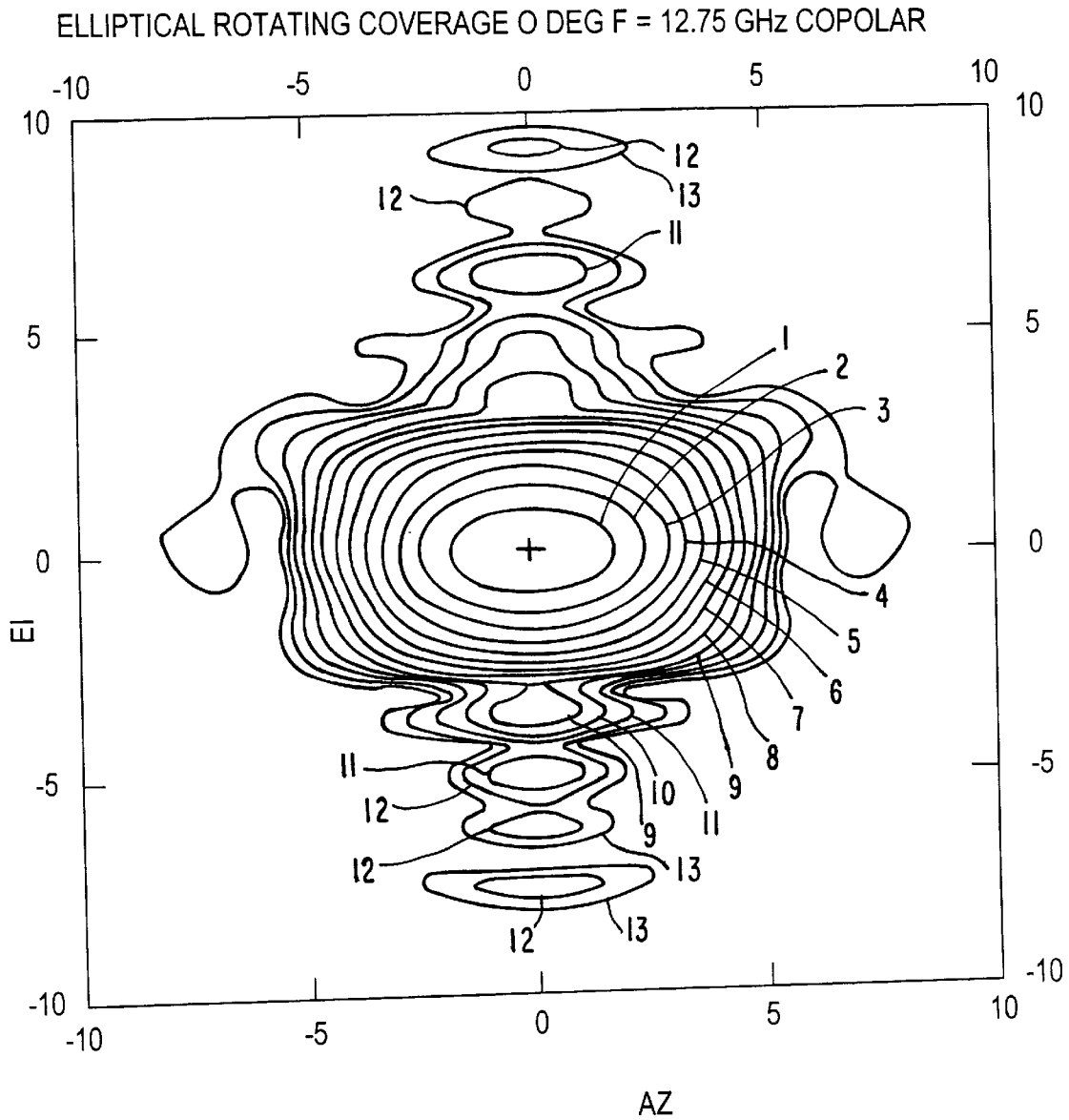
FIG. 10*a* shows a co-polar radiation pattern of the antenna of FIG. 8 with the elliptically shaped sub-reflector rotated at an angle of rotation of 0°.
Figure 10B:
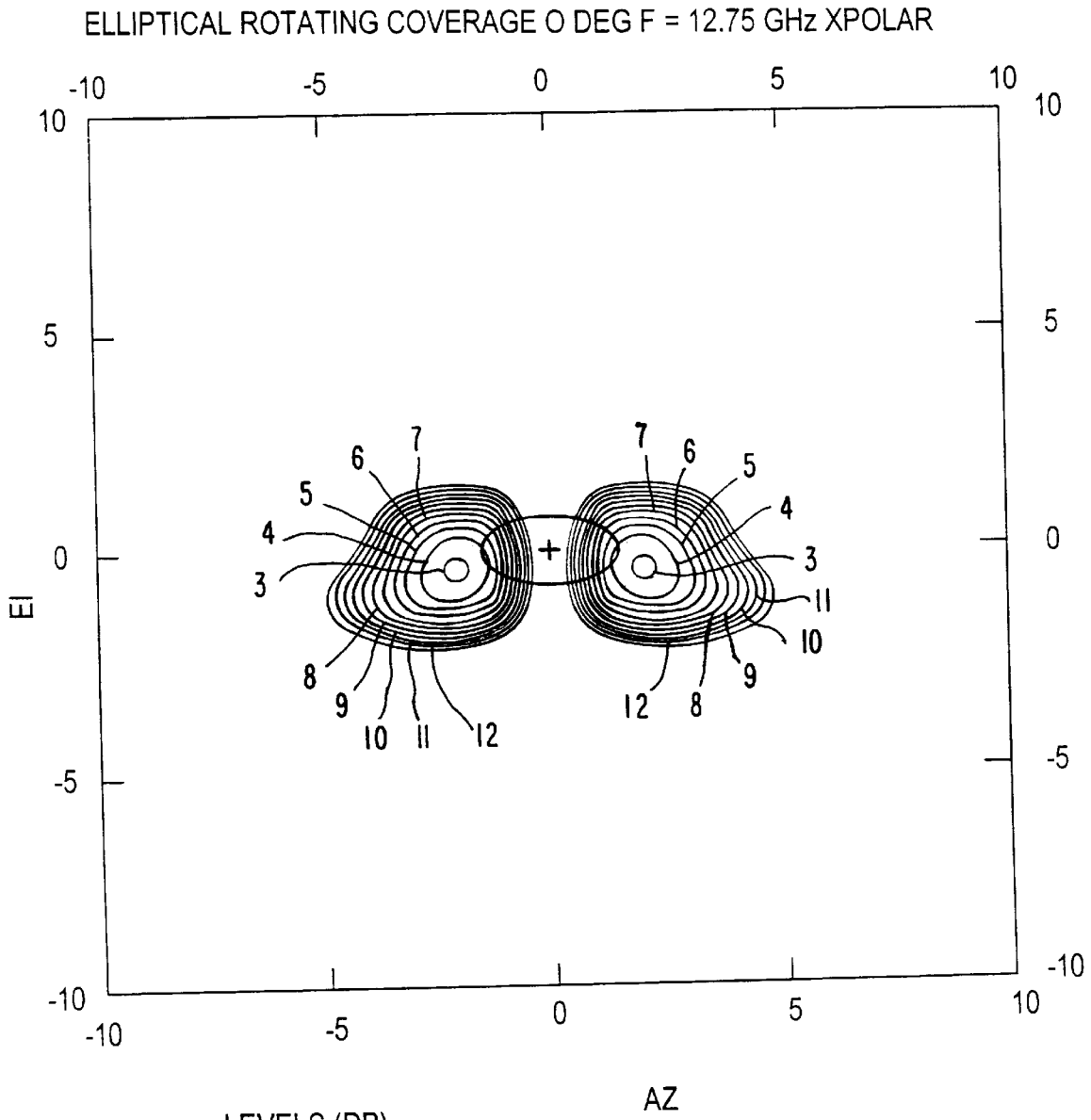
FIG. 10*b* shows a cross-polar radiation pattern of the antenna of FIG. 8 with the elliptically shaped sub-reflector rotated at an angle of rotation of 0°.
Figure 11A:
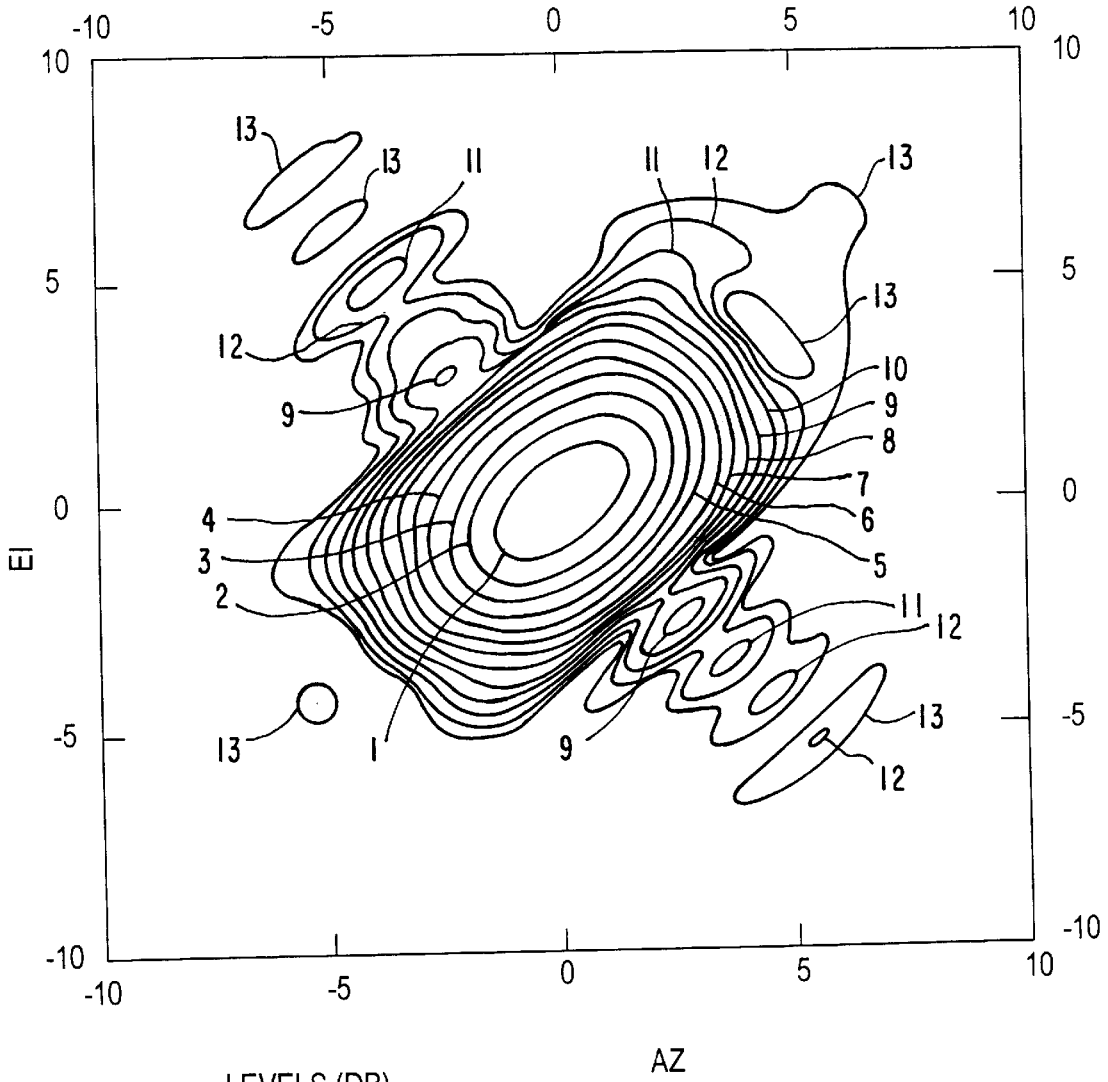
FIG. 11*a* shows a co-polar radiation pattern of the antenna of FIG. 8 with the elliptically shaped sub-reflector rotated at an angle of rotation of 45°.
Figure 11B:
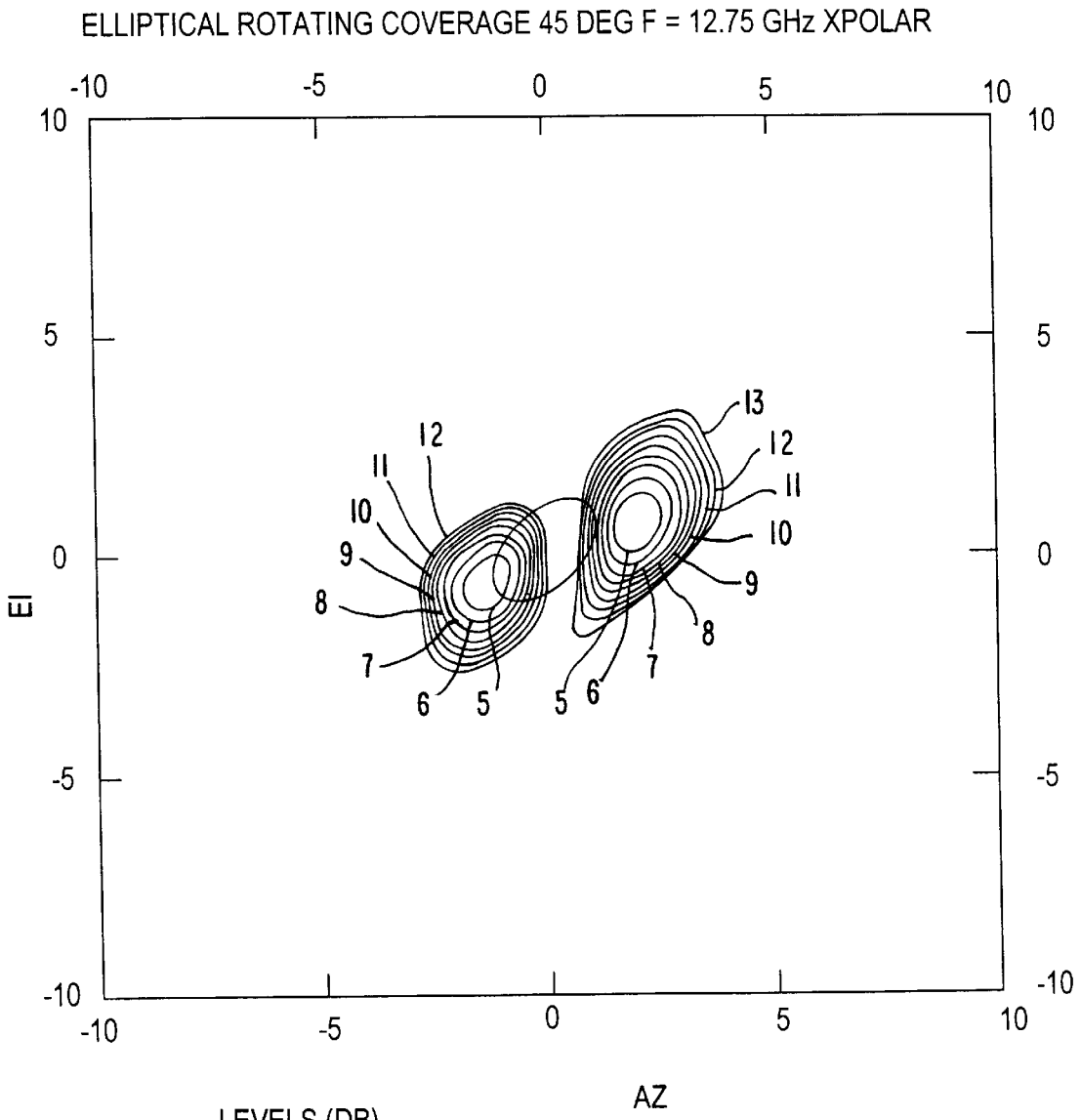
FIG. 11*b* shows a cross-polar radiation pattern of the antenna of FIG. 8 with the elliptically shaped sub-reflector rotated at an angle of rotation of 45°.
Figure 12A:
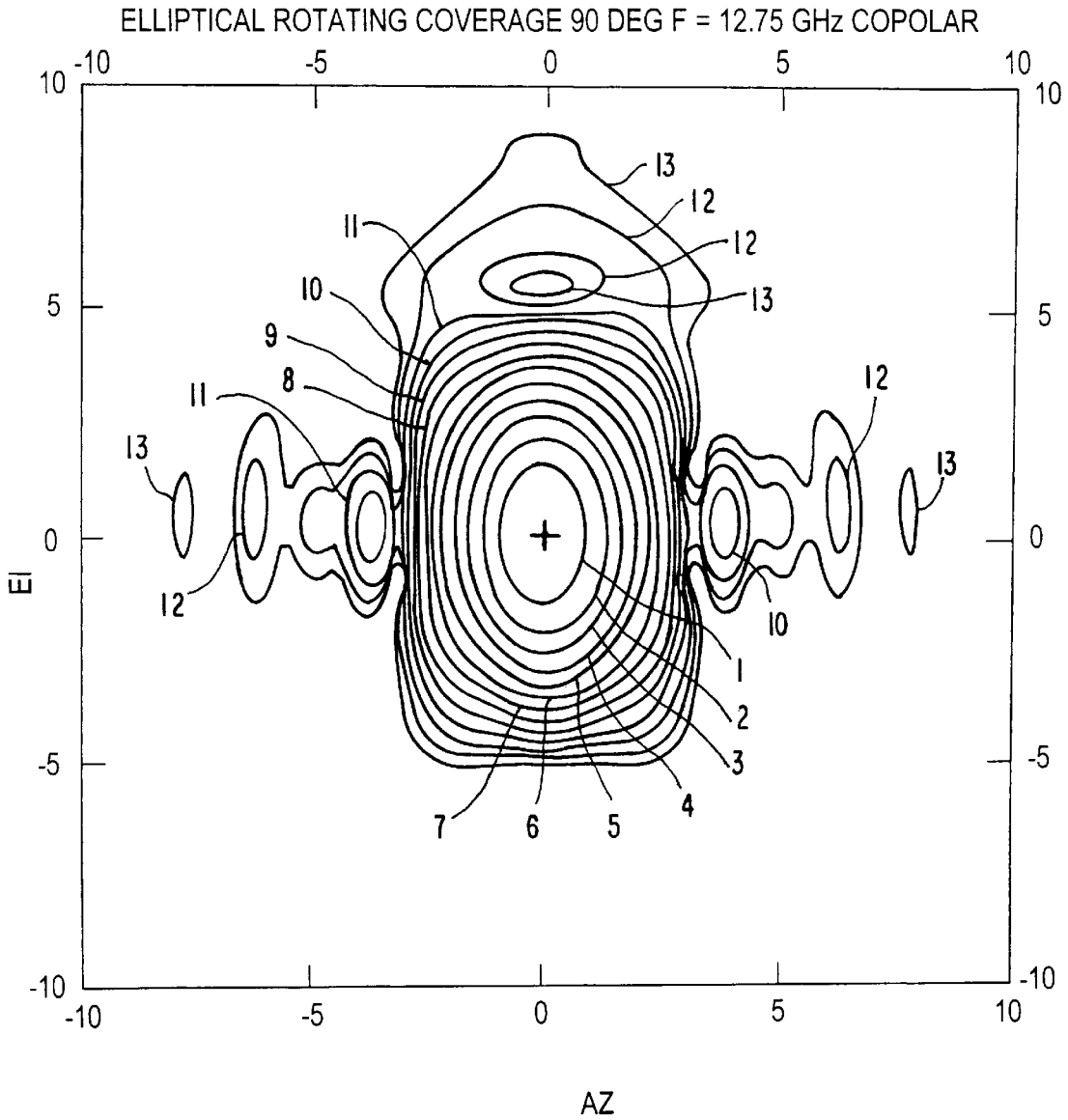
FIG. 12*a* shows a co-polar radiation pattern of the antenna of FIG. 8 with the elliptically shaped sub-reflector rotated at an angle of rotation 90°.
Figure 12B:
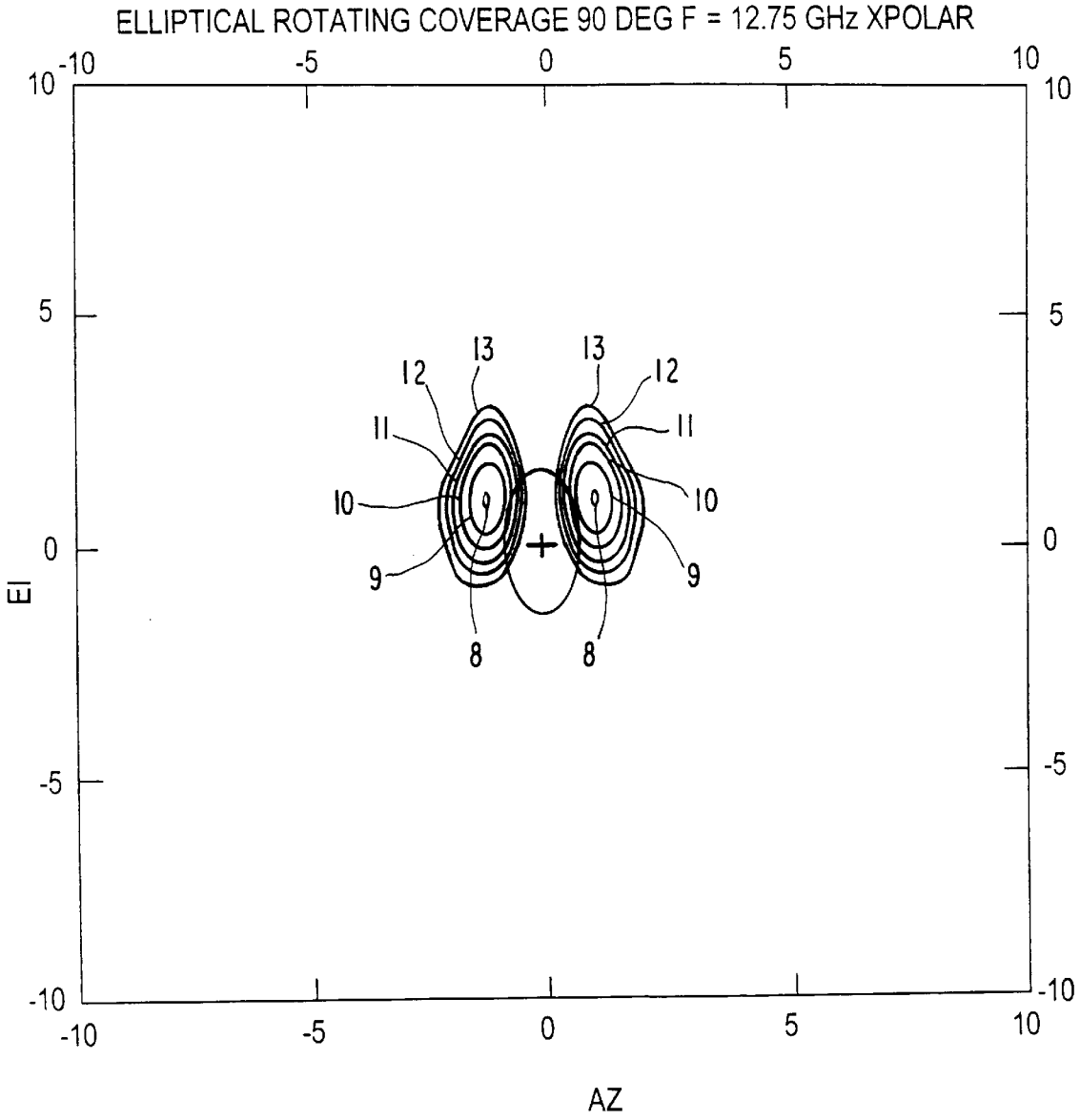
FIG. 12*b* shows a cross-polar radiation pattern of the antenna of FIG. 8 with the elliptically shaped sub-reflector rotated at an angle of rotation of 90°.

The radiation patterns obtained for three positions of the sub-reflector rotated by 0°, 45° and 90°, around axis 4 are shown in FIGS. 10, 11 and 12, respectively. Radiation patterns of the co-polar components for each of the three orientations is shown in FIGS. 10*a*, 11*a*, 12*a*, respectively, similar to that previously shown in FIG. 9*a*, and the corresponding cross-polar values are shown in FIGS. 10*b*, 11*b*, 12*b* with the same representation in relative decibel as that previously shown in FIG. 9*b*. These figures show the substantial invariance to rotation of the co-polar elliptical beam irrespective of analytical shaping of the surfaces of the sub-reflector and main reflector. Moreover, the cross-polarization levels are maintained at extremely low values in line with the initial figures. As a result of these characteristics, the antenna is suitable for use on board satellites with re-use of the polarization in an operational environment with one or more simultaneously active beams.

B. Elliptical Beam Rotation and Zoom Functions

Examples will now be described of zooming or widening of the elliptical beam of nominal dimensions 1.6°×3.0°, shown in FIGS. 10, 11 and 12, to achieve a nominal coverage of 1.9°×4.3° and translation of main reflector 3 or sub-reflector 2 of FIG. 8 along axis 5.

Figure 13A:
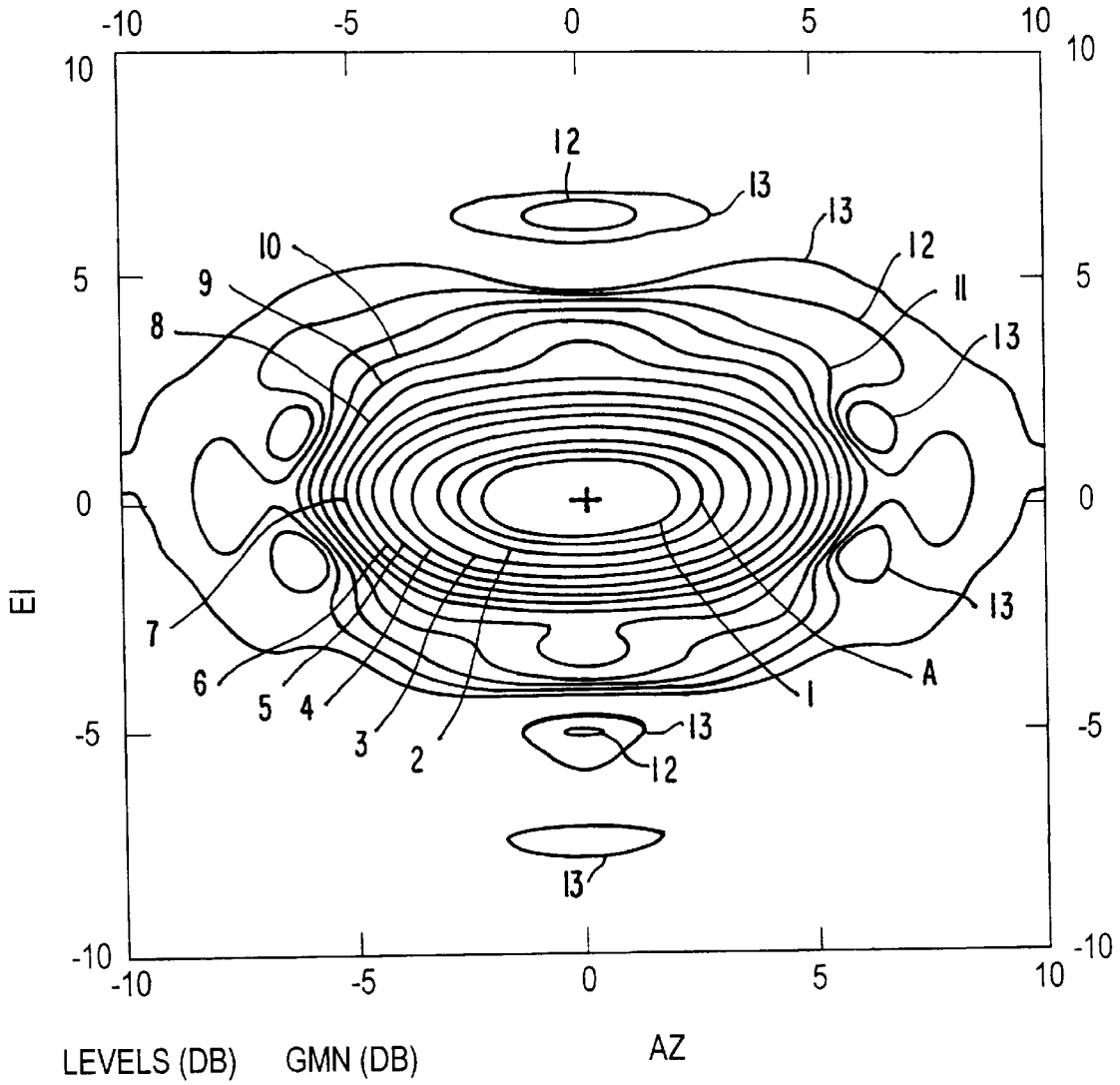
FIG. 13*a* shows a co-polar radiation pattern of the antenna of FIG. 8 with the elliptically shaped sub-reflector rotated at an angle of 0° and translated by 50 mm along axis 5 towards main reflector 3.
Figure 13B:
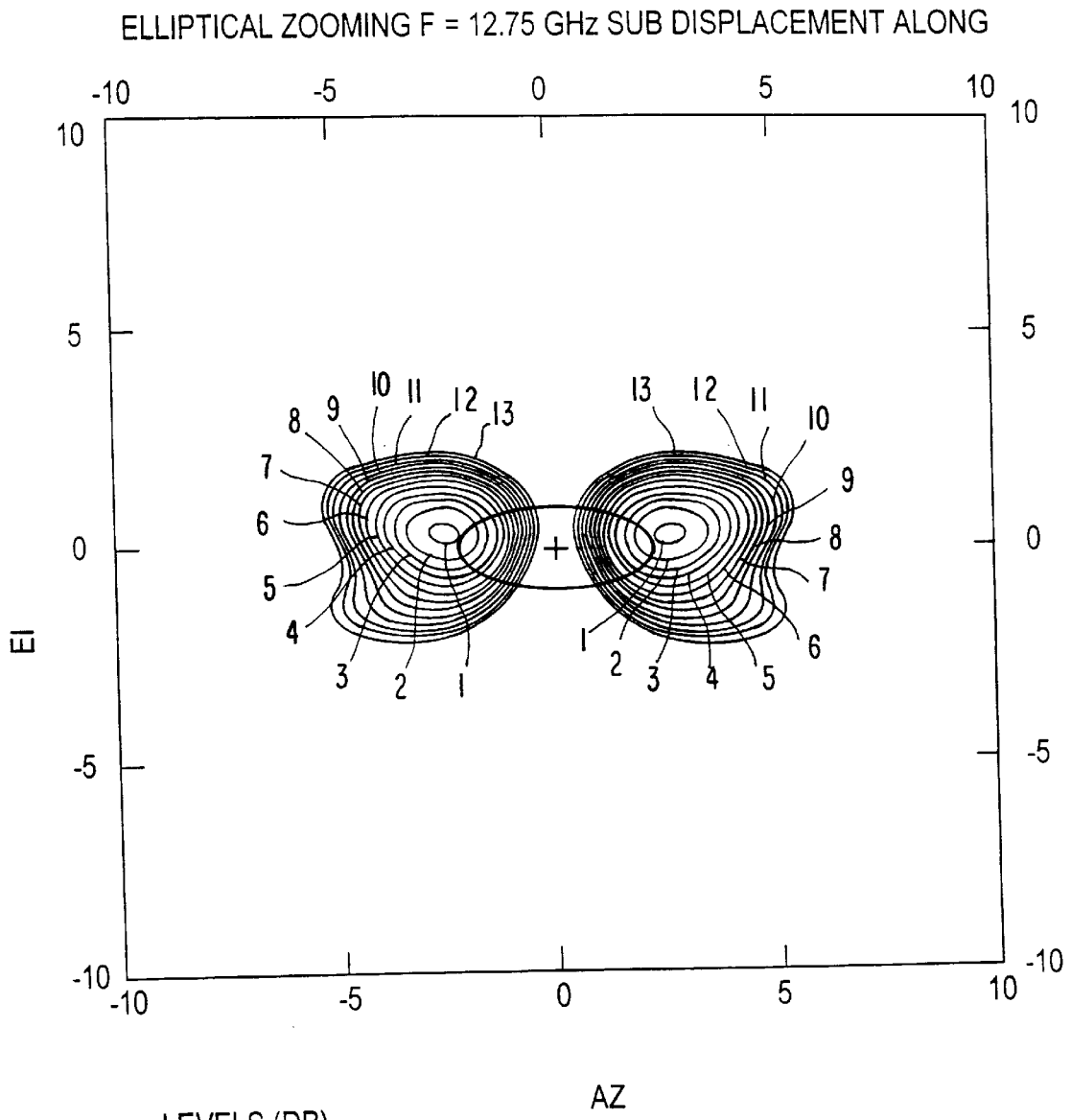
FIG. 13*b* shows a cross-polar radiation pattern of the antenna of FIG. 8 with the elliptically shaped sub-reflector rotated at an angle of 0° and translated by 50 mm along axis 5 towards main reflector 3.
Figure 14A:
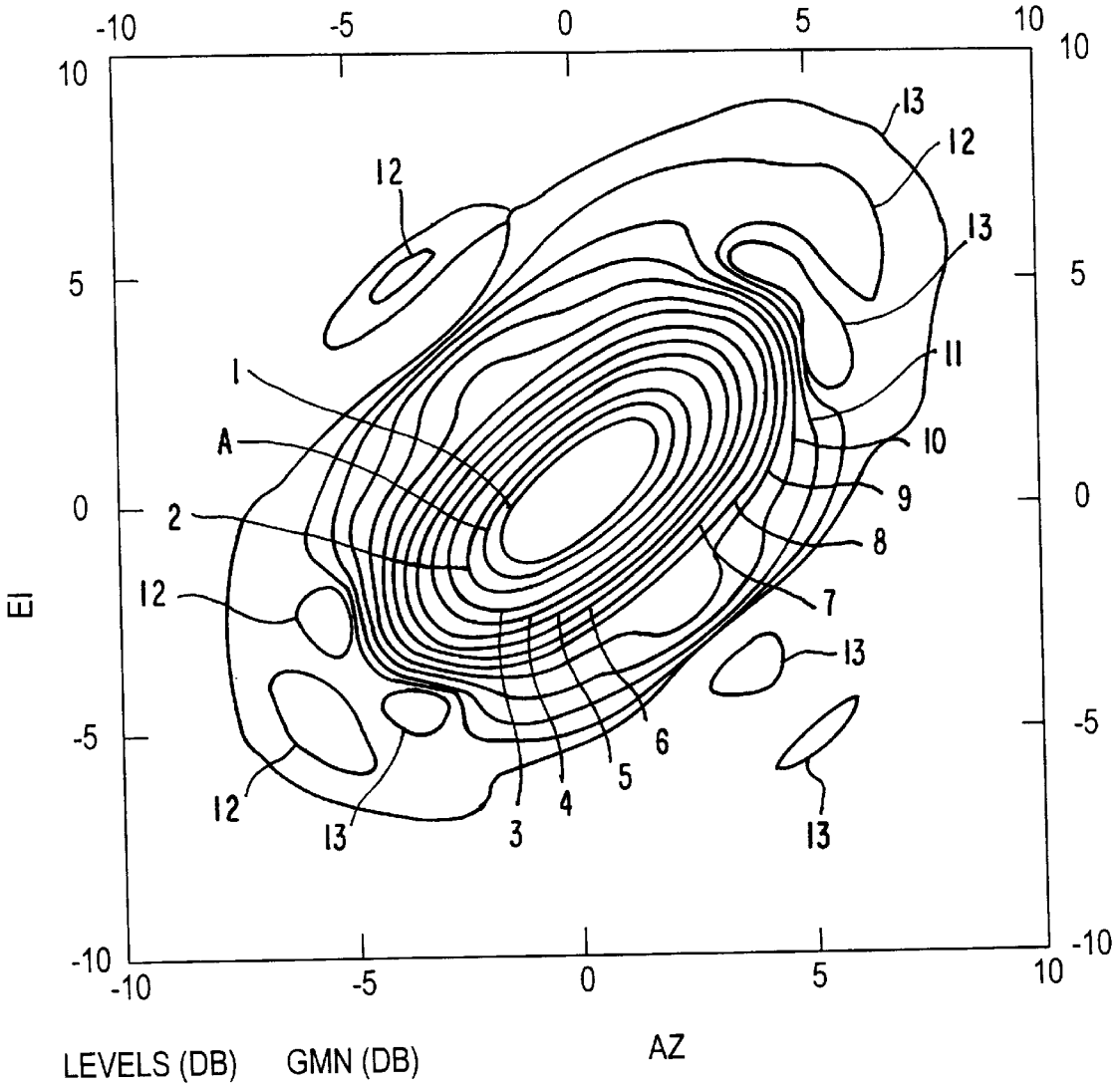
FIG. 14*a* shows a co-polar radiation pattern of the antenna of FIG. 8 with the elliptically shaped sub-reflector rotated at an angle of 45° and translated by 50 mm along axis 5 towards main reflector 3.
Figure 14B:
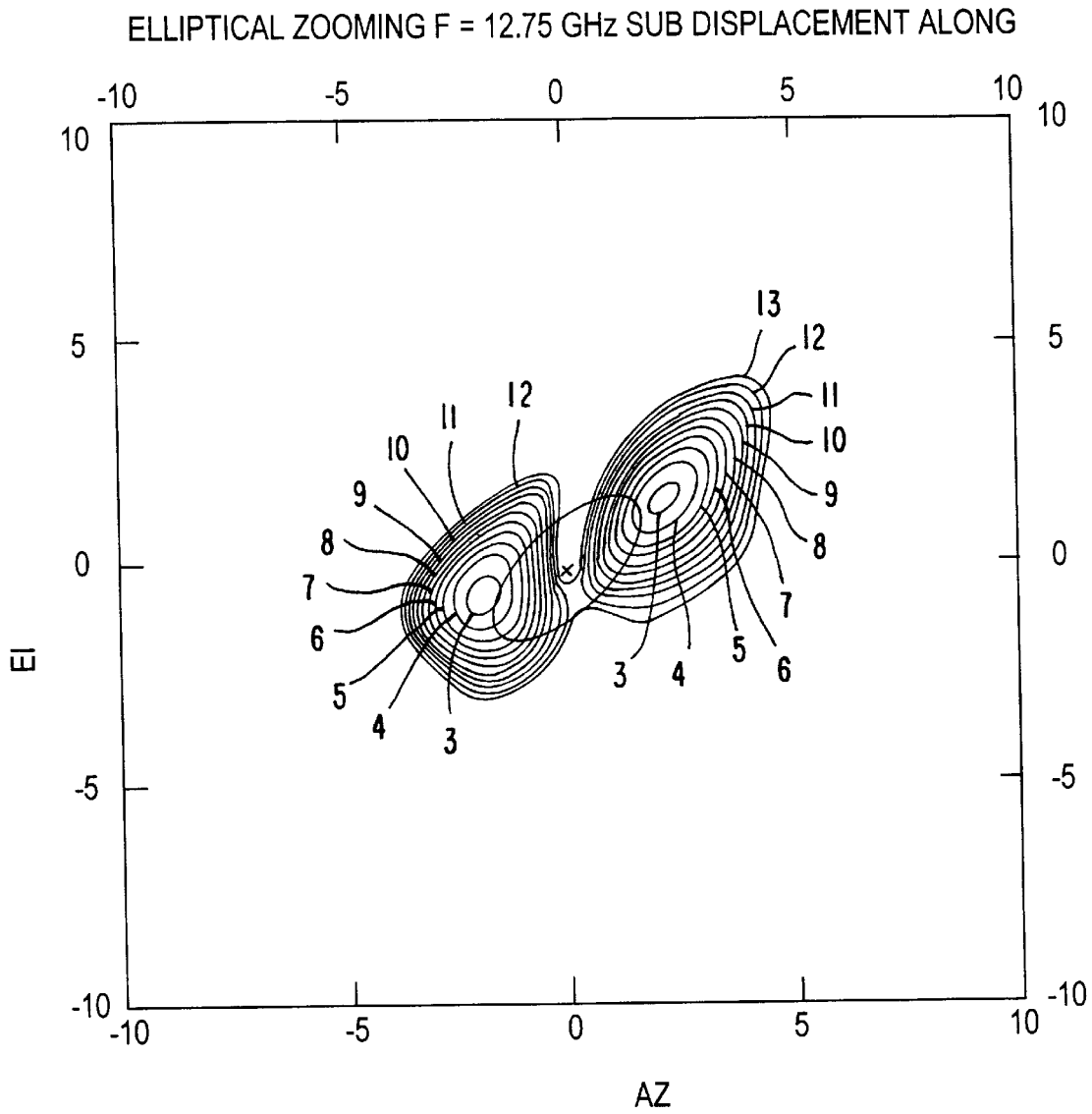
FIG. 14*b* shows a cross-polar radiation pattern of the antenna of FIG. 8 with the elliptically shaped sub-reflector rotated at an angle of 45° and translated by 50 mm along axis 5 towards main reflector 3.
Figure 15A:
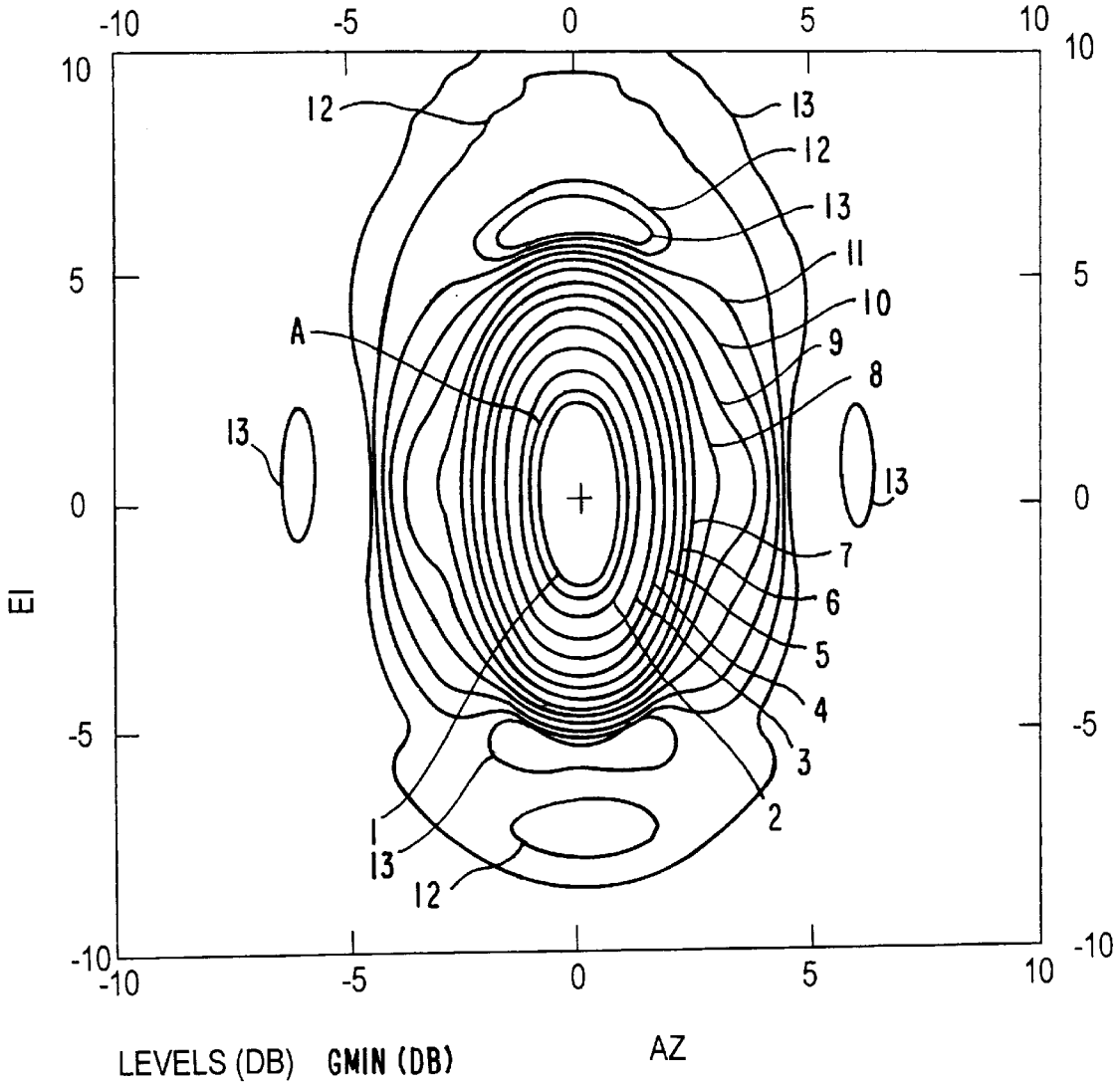
FIG. 15*a* shows a co-polar radiation pattern of the antenna of FIG. 8 with the elliptically shaped sub-reflector rotated at an angle of 90° and translated by 50 mm along axis 5 towards main reflector 3.
Figure 15B:
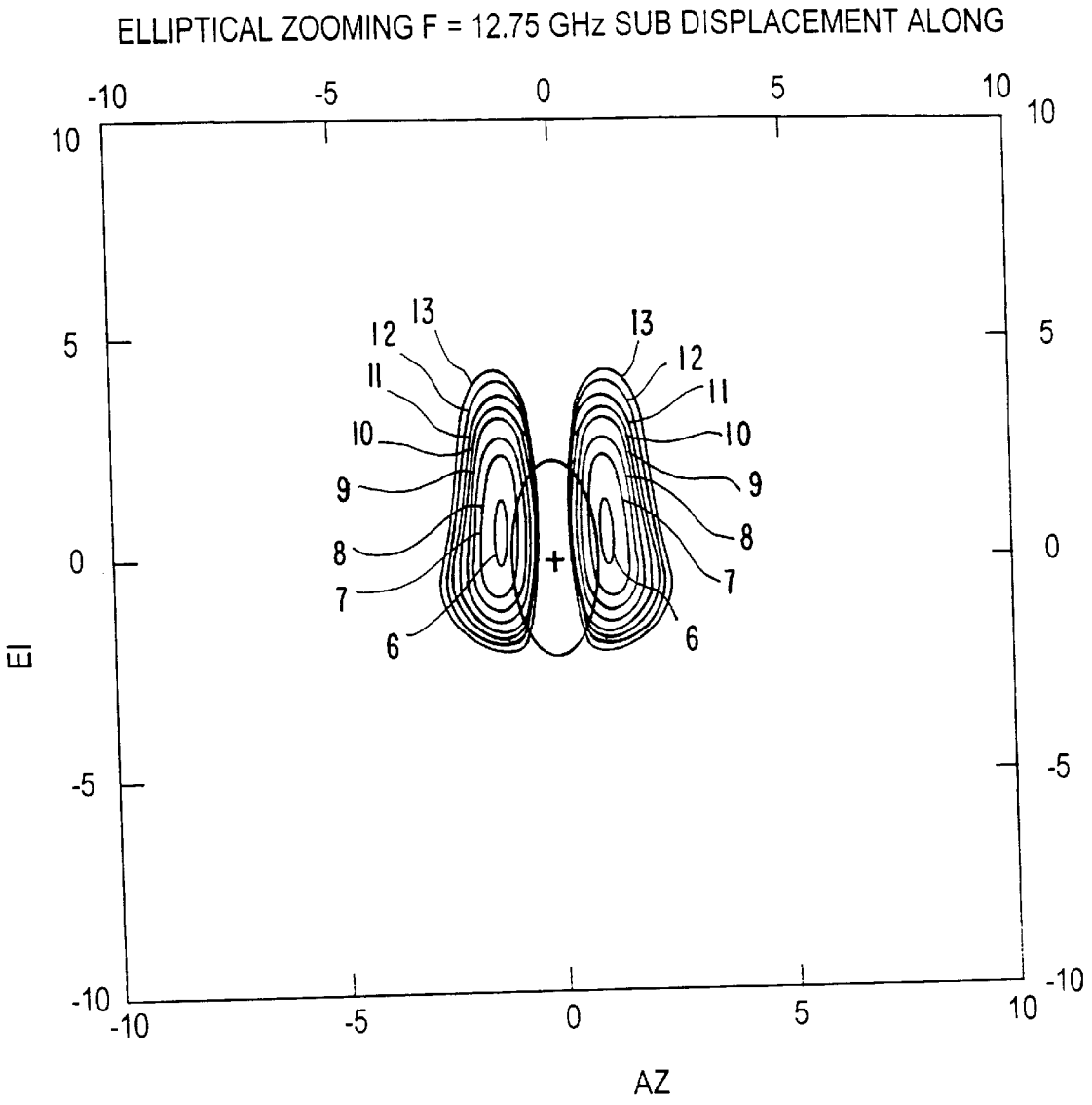
FIG. 15*b* shows a cross-polar radiation pattern of the antenna of FIG. 8 with the elliptically shaped sub-reflector rotated at an angle of 90° and translated by 50 mm along axis 5 towards main reflector 3.

FIGS. 13, 14 and 15 show the zoom effect of the elliptical beam for the three rotations obtained by combining rotation of sub-reflector 2 and translation of sub-reflector 2 for a distance of 50 mm along axis 5 of FIG. 8 towards main reflector 3. The three orientations of the sub-reflector with respect to axis 4 are at 0°, 45° and 90°, the same rotations previously analyzed in connection with respective FIGS. 10, 11, 12. The radiation patterns of the co-polar components are shown in FIGS. 13*a*, 14*a*, 15*a*, and the corresponding radiation patterns of the cross-polar values are shown in FIGS. 13*b*, 14*b*, 15*b*, respectively. As is evident from these radiation patterns, the elliptical beam zoom function is realized with substantially no rotational variance of the elliptical beam at extremely controlled cross-polar values and in line with the initial cross-polarization of the original beam.

Figure 16A:
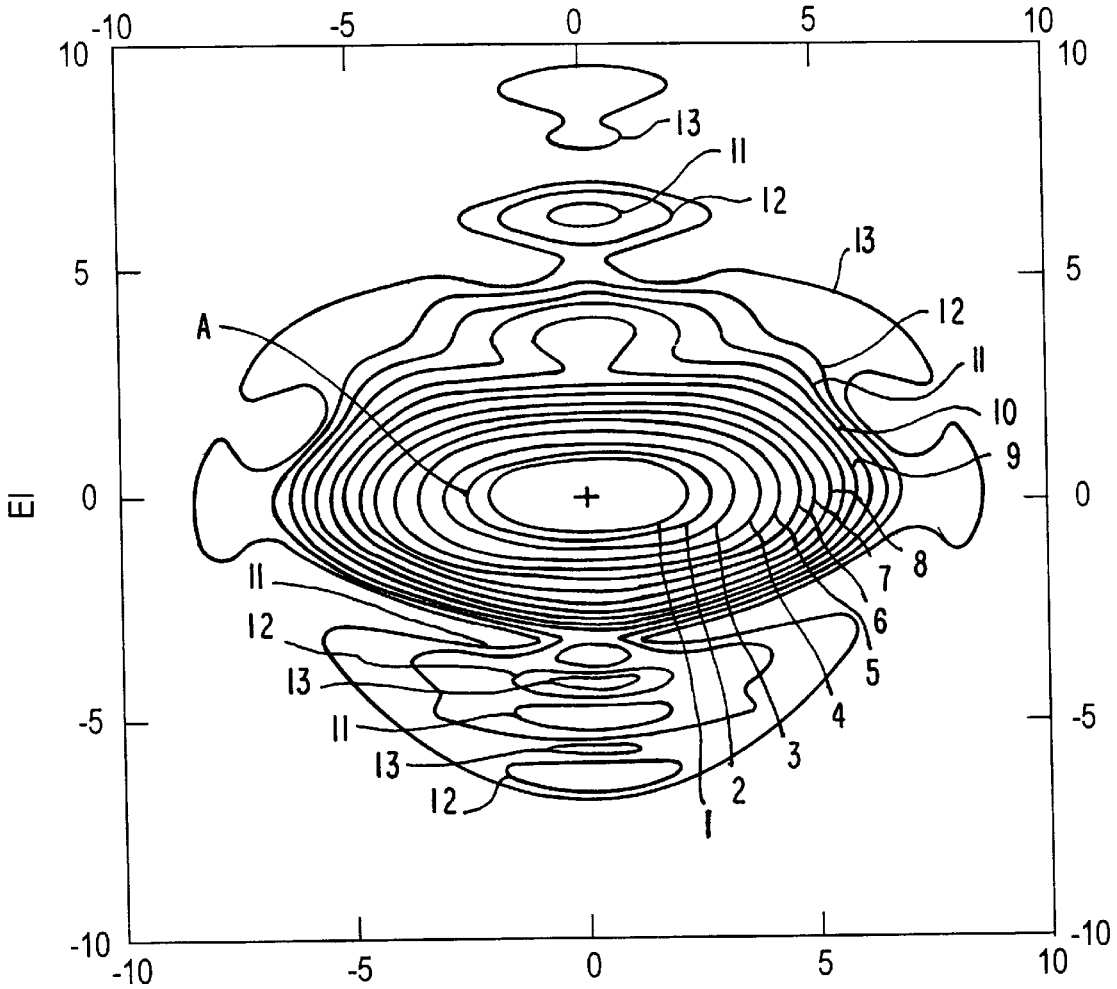
FIG. 16*a* shows a co-polar radiation pattern of the antenna of FIG. 8 with the elliptically shaped sub-reflector rotated at an angle of 0° and the main reflector translated by 100 mm along axis 5.
Figure 16B:
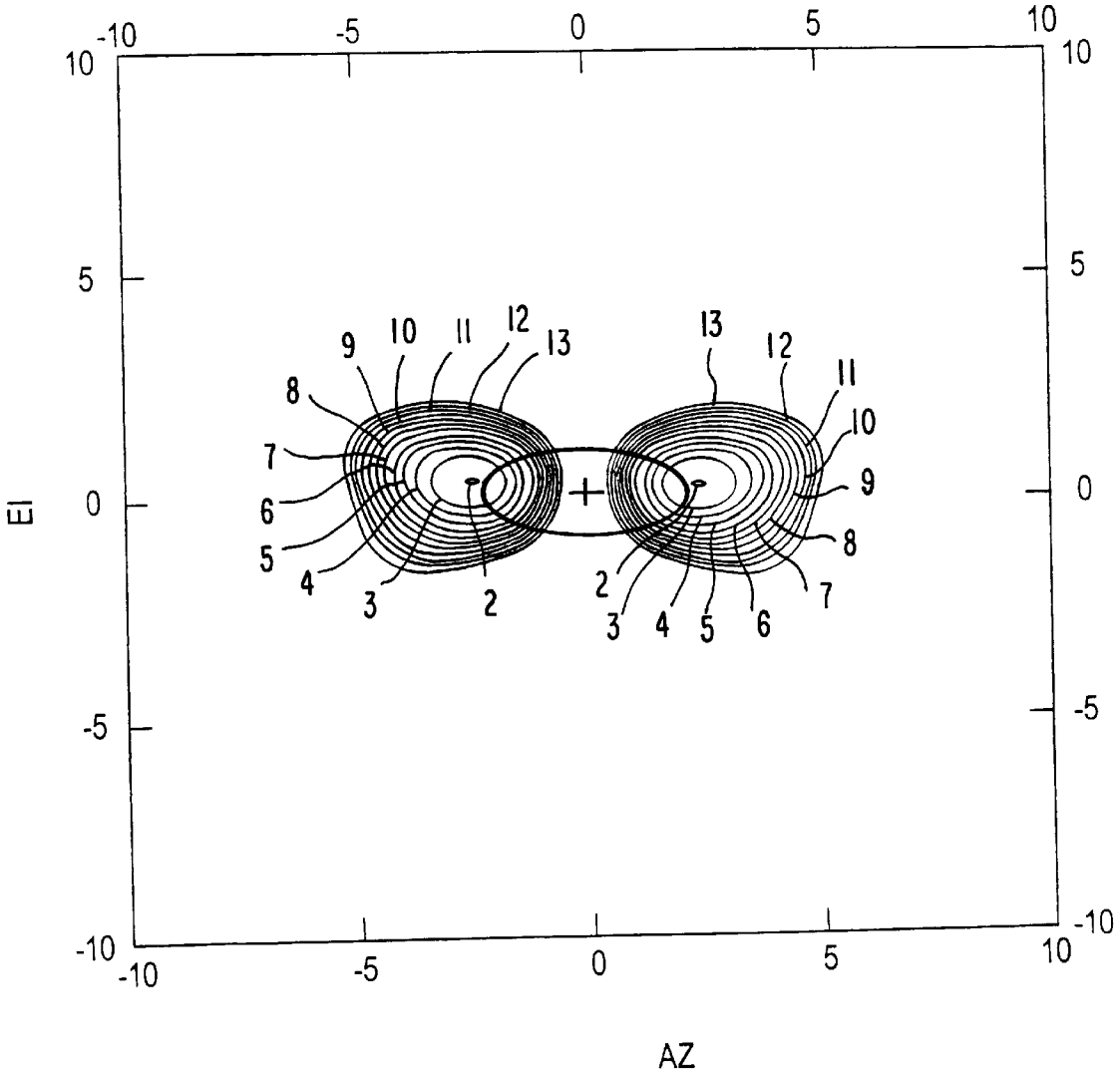
FIG. 16*b* shows a cross-polar radiation pattern of the antenna of FIG. 8 with the elliptically shaped sub-reflector rotated at an angle of 0° and the main reflector translated by 100 mm along axis 5.
Figure 17A:
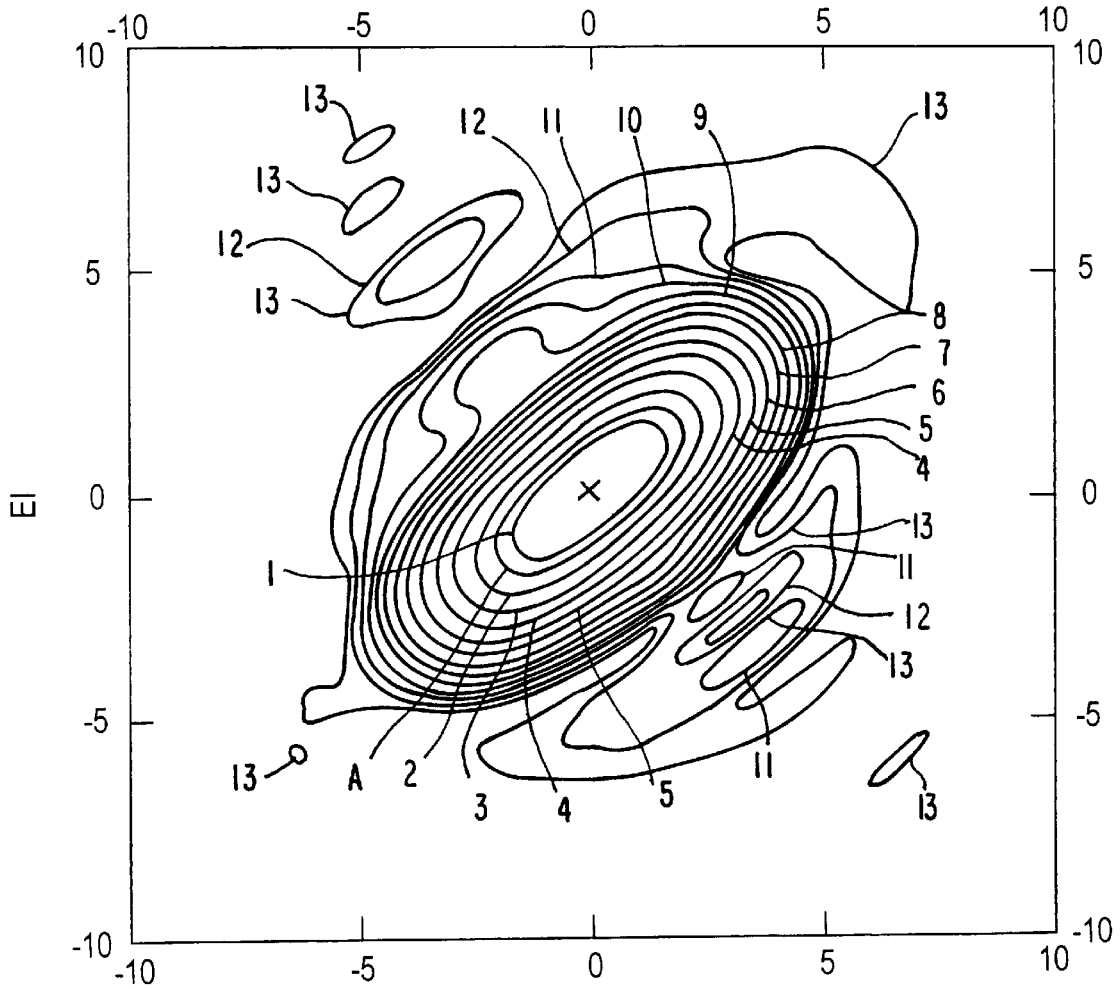
FIG. 17*a* shows a co-polar radiation pattern of the antenna of FIG. 8 with the elliptically shaped sub-reflector rotated at an angle of 45° and the main reflector translated by 100 mm along axis 5.
Figure 17B:
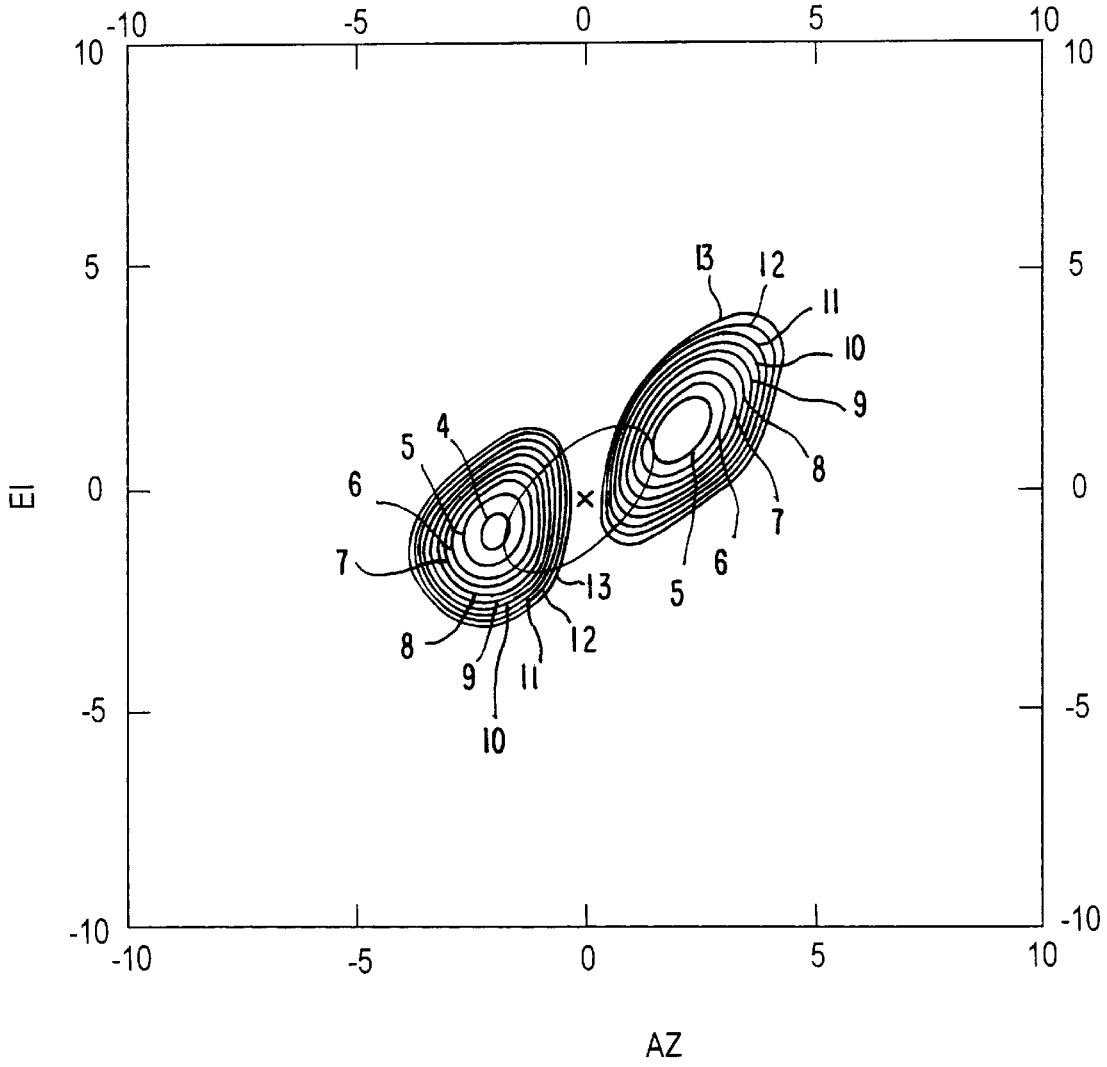
FIG. 17*b* shows a cross-polar radiation pattern of the antenna of FIG. 8 with the elliptically shaped sub-reflector rotated at an angle of 45° and the main reflector translated by 100 mm along axis 5.
Figure 18A:
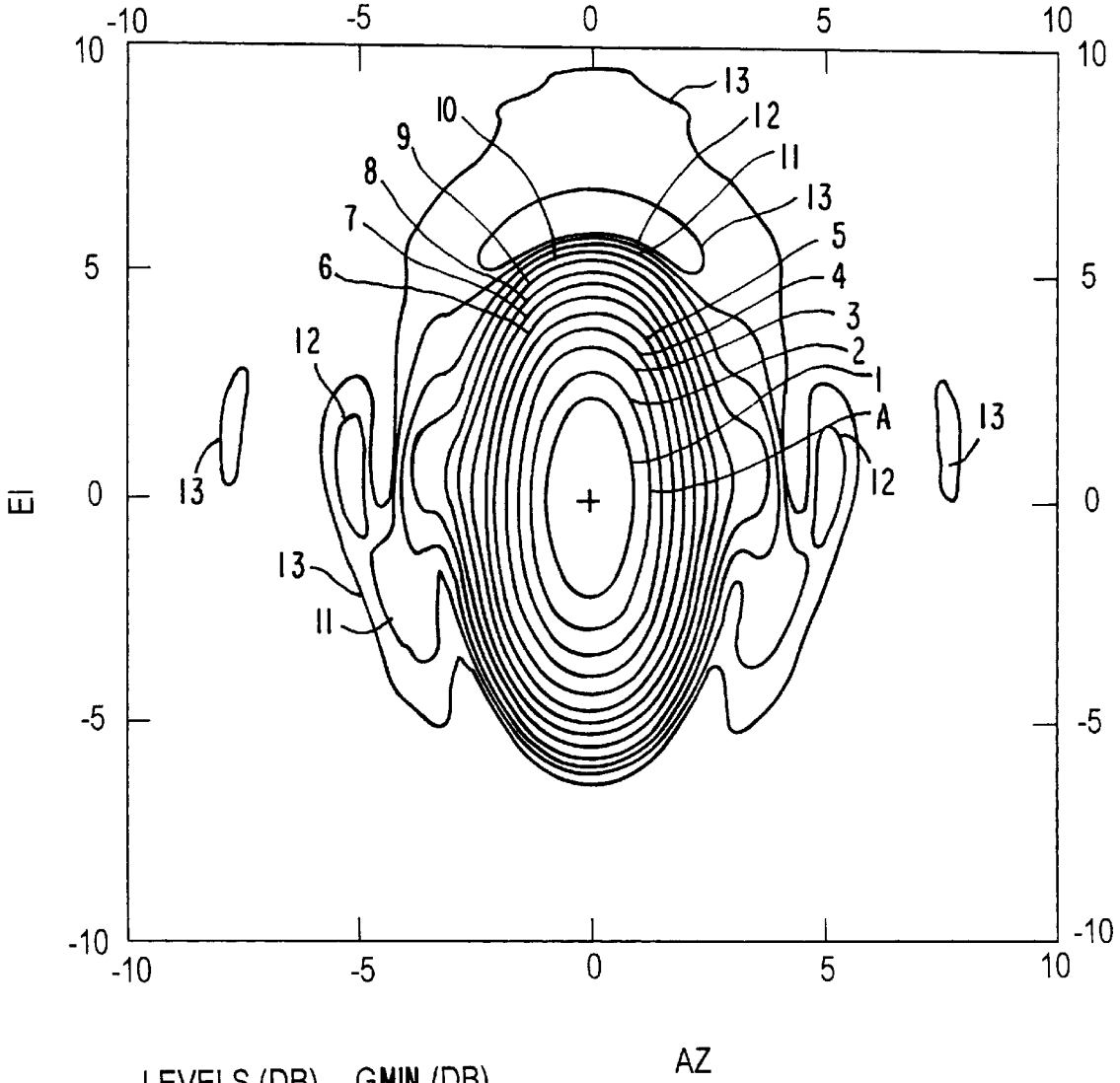
FIG. 18*a* shows a co-polar radiation pattern of the antenna of FIG. 8 with the elliptically shaped sub-reflector rotated at an angle of 90° and the main reflector translated by 100 mm along axis 5.
Figure 18B:
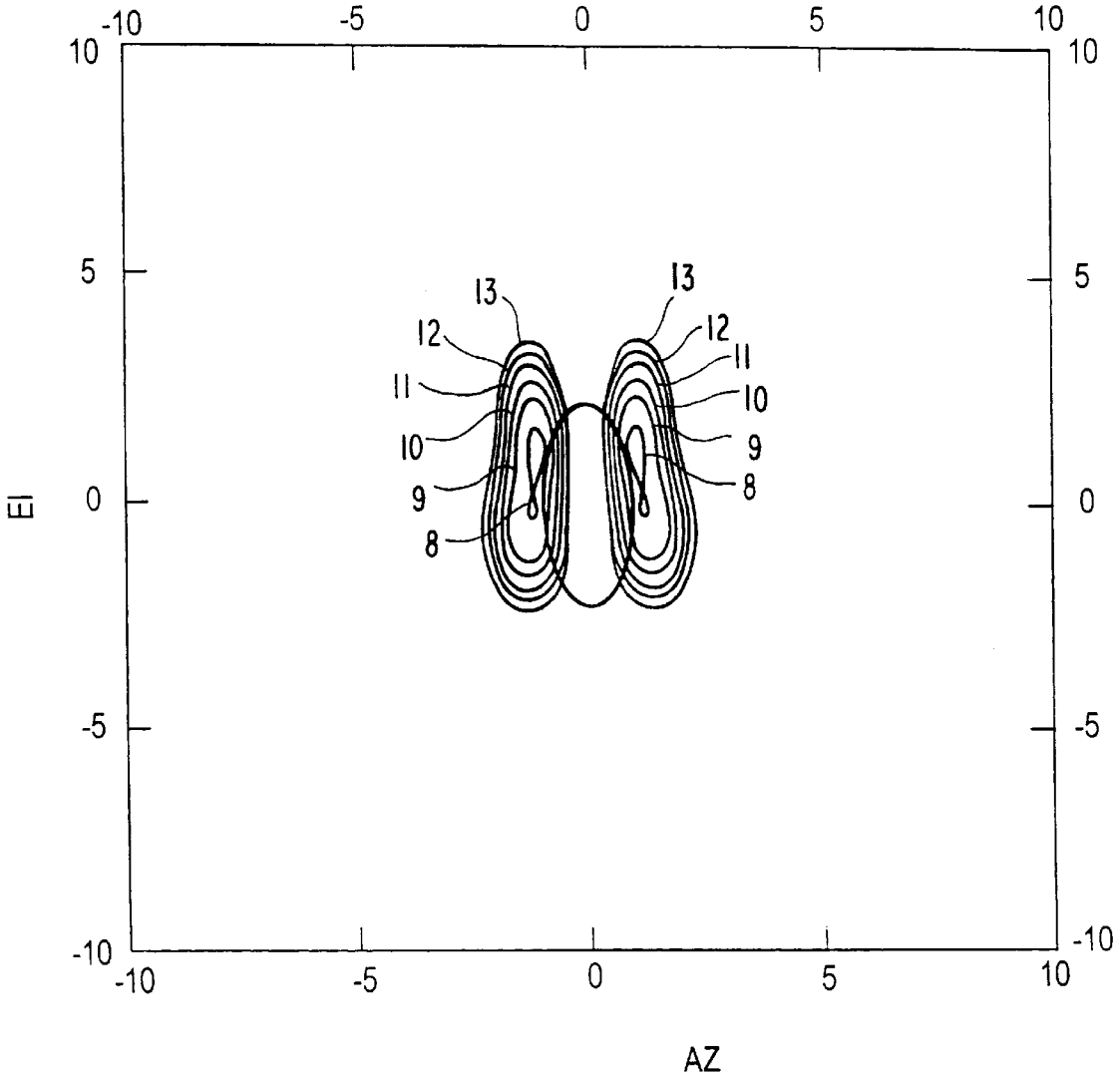
FIG. 18*b* shows a cross-polar radiation pattern of the antenna of FIG. 8 with the elliptically shaped sub-reflector rotated at an angle of 90° and the main reflector translated by 100 mm along axis 5.

In an alternative embodiment, the same widening effect of the elliptical beam may be achieved by translating the main reflector 3 of FIG. 8 along axis 5, instead of sub-reflector 2. The results obtained by translating main reflector 3 by 100 mm along axis 5 of FIG. 8 are shown in FIGS. 16, 17, 18 for the same three orientations 0°, 45° and 90°, respectively. In particular, FIGS. 16*a*, 17*a* and 18*a* show the radiation pattern of the co-polar component, and the corresponding cross-polar radiation patterns are shown in FIGS. 16*b*, 17*b* and 18*b*, respectively. These figures reveal that regardless of the orientation of the sub-reflector, the widening or zoom effect of the elliptical beam results in extremely low cross-polar values.

C. Elliptical Beam Rotation and Reconfiguration Function

The continuous variation of the elliptical contour into a circular contour may be accomplished using the optical system shown in FIG. 8 by combining rotation with translation of the sub-reflector or main reflector, but in an opposite direction to that used for the widening or zoom of the elliptical beam described above in section I(B).

Figure 19A:
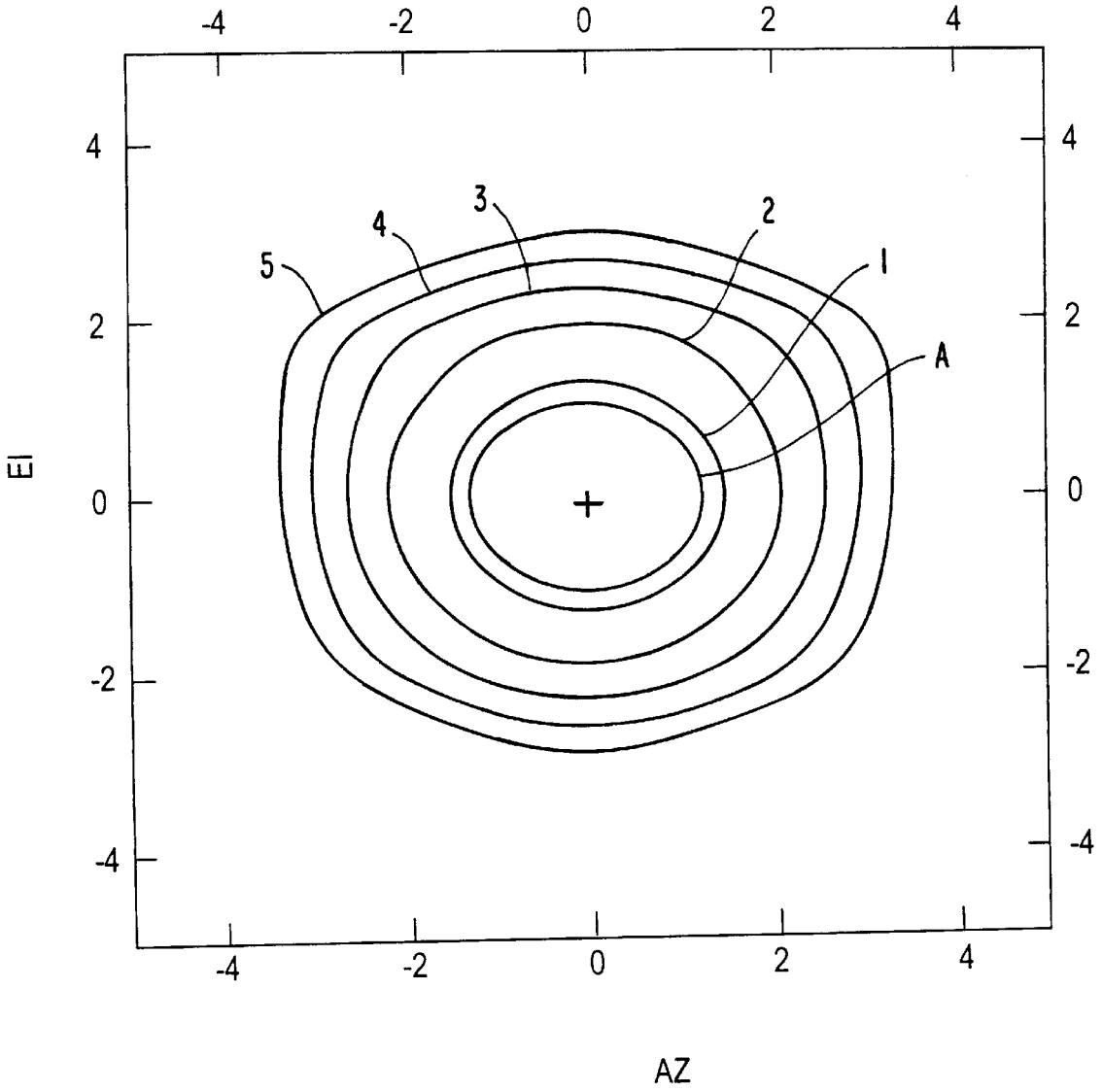
FIG. 19*a* shows a co-polar radiation pattern of the antenna of FIG. 8 with the elliptically shaped sub-reflector rotated at an angle of 0° and the main reflector translated by −50 mm along axis 5.
Figure 19B:
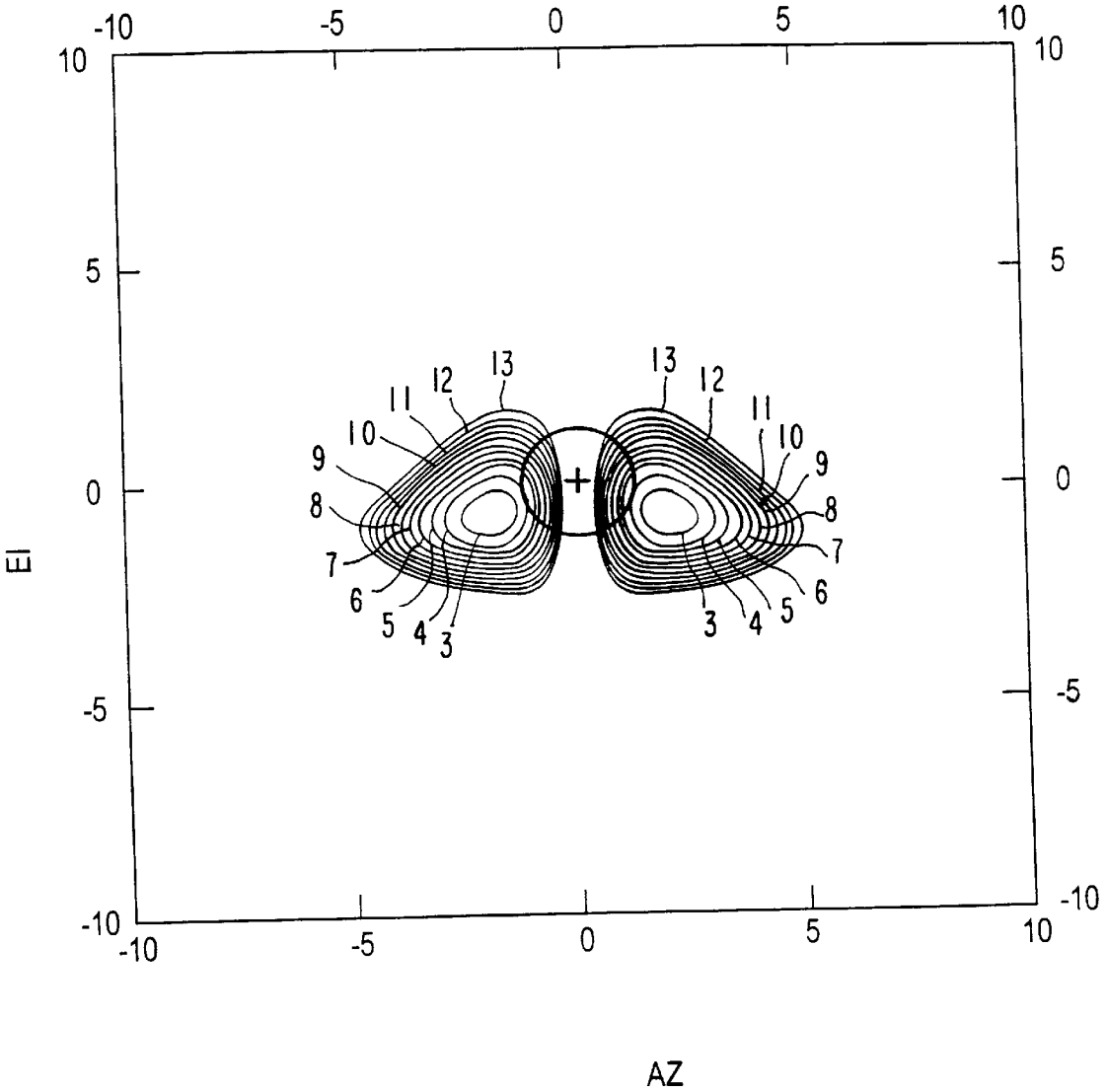
FIG. 19*b* shows a cross-polar radiation pattern of the antenna of FIG. 8 with the elliptically shaped sub-reflector rotated at an angle of 0° and the main reflector translated by −50 mm along axis 5.
Figure 20A:
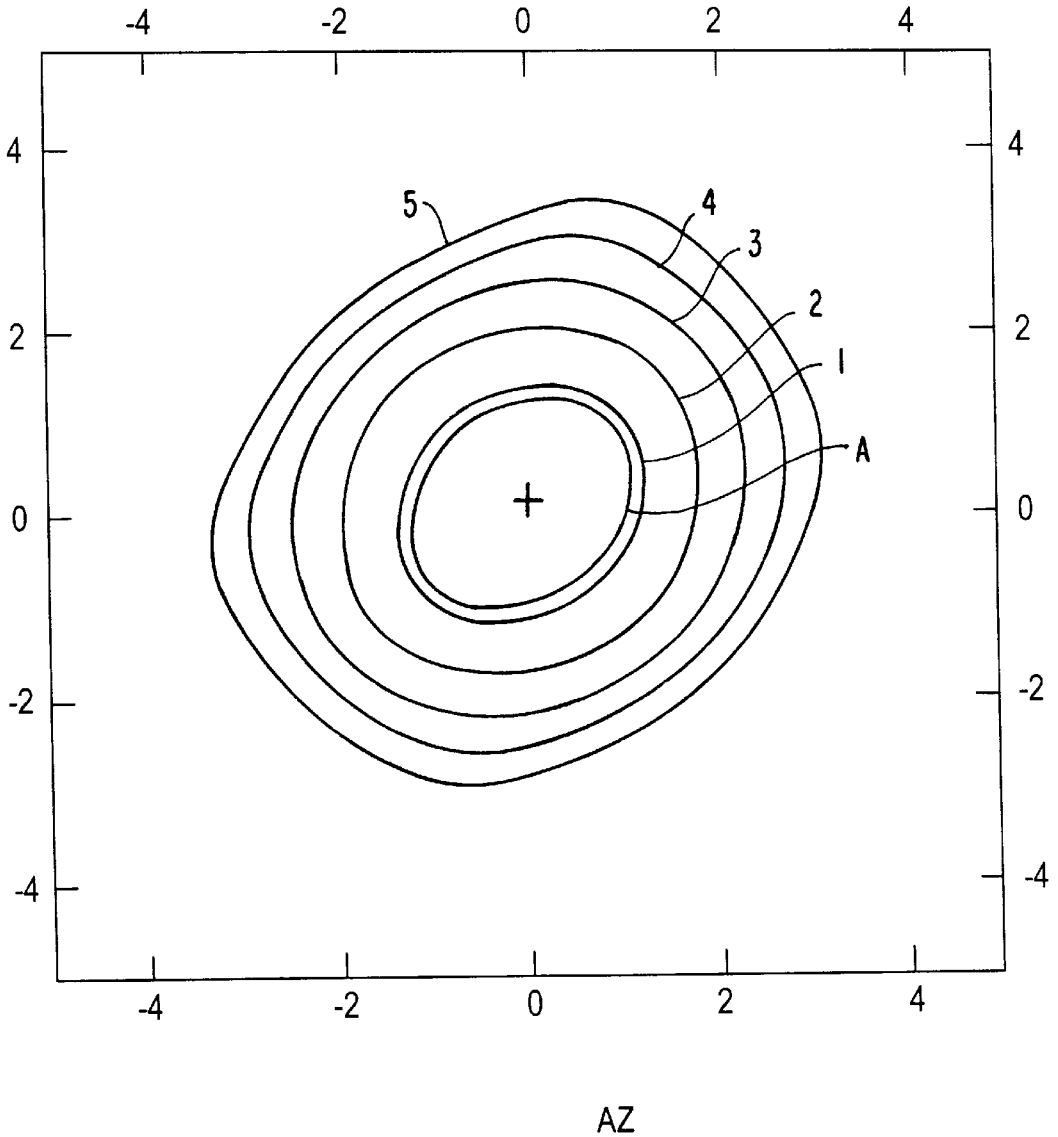
FIG. 20*a* shows a co-polar radiation pattern of the antenna of FIG. 8 with the elliptically shaped sub-reflector rotated at an angle of 45° and the main reflector translated by −50 mm along axis 5.
Figure 20B:
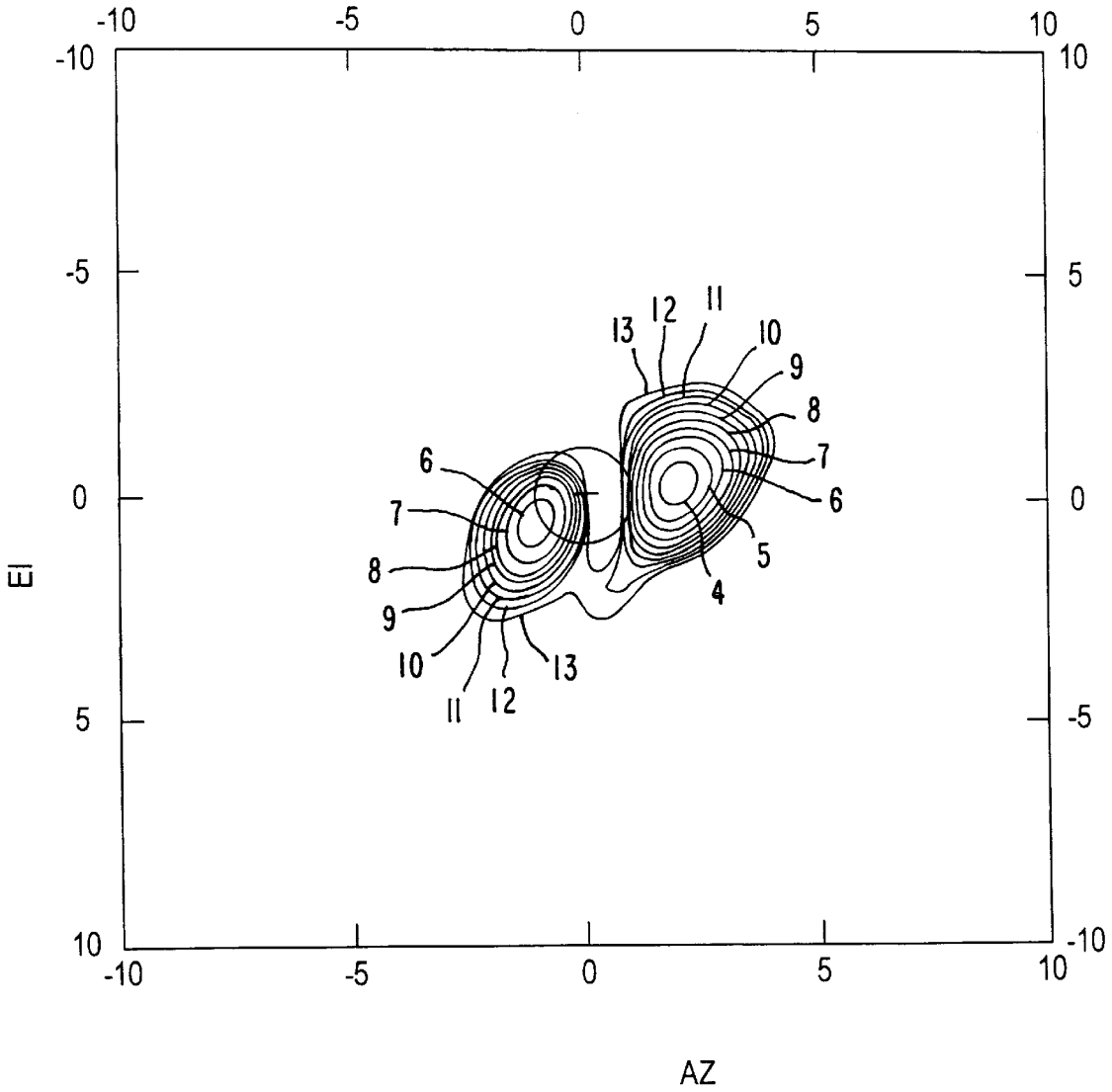
FIG. 20*b* shows a cross-polar radiation pattern of the antenna of FIG. 8 with the elliptically shaped sub-reflector rotated at an angle of 45° and the main reflector translated by −50 mm along axis 5.
Figure 21A:
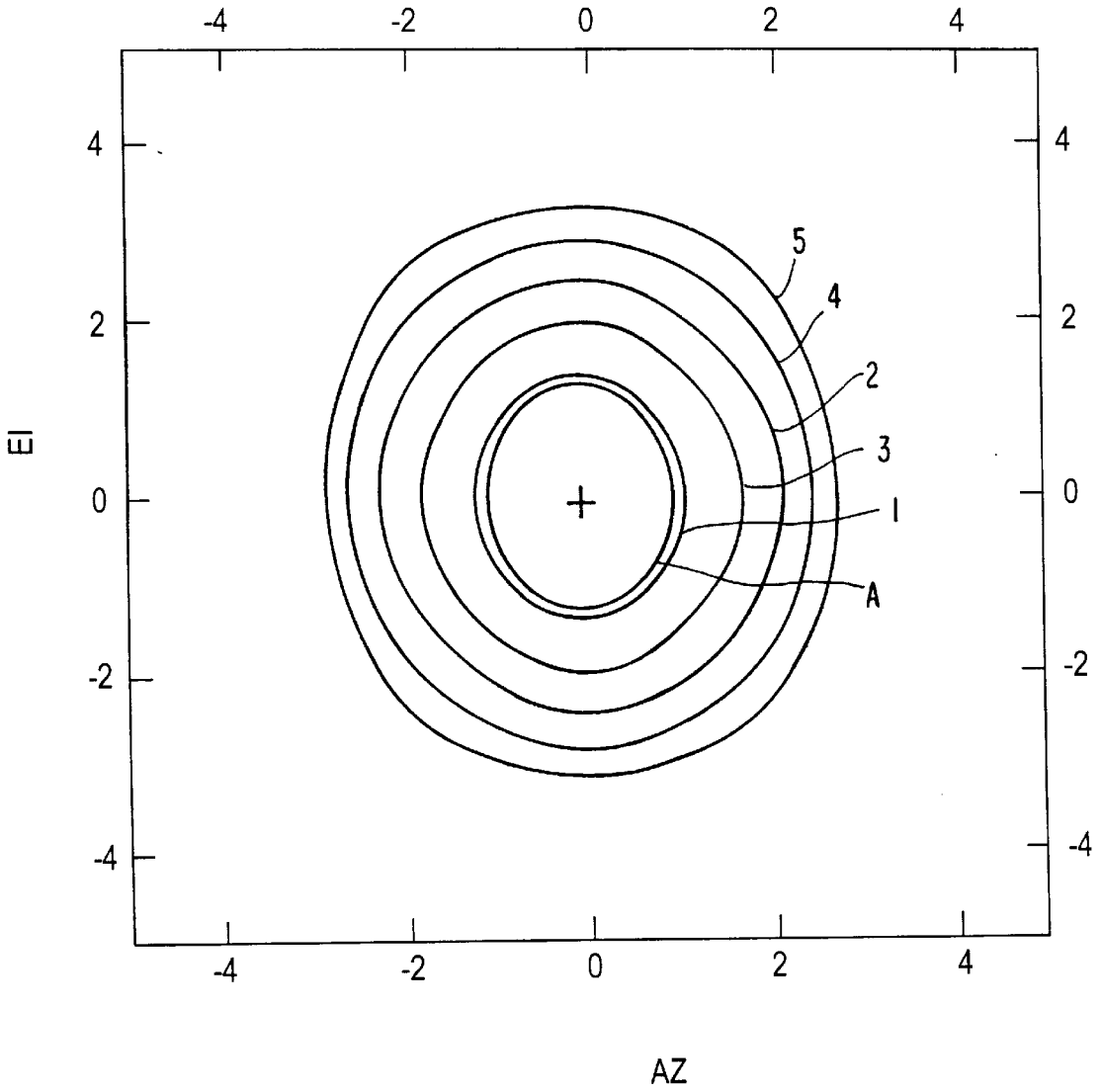
FIG. 21*a* shows a co-polar radiation pattern of the antenna of FIG. 8 with the elliptically shaped sub-reflector rotated at an angle of 90° and the main reflector translated by −50 mm along axis 5.
Figure 21B:
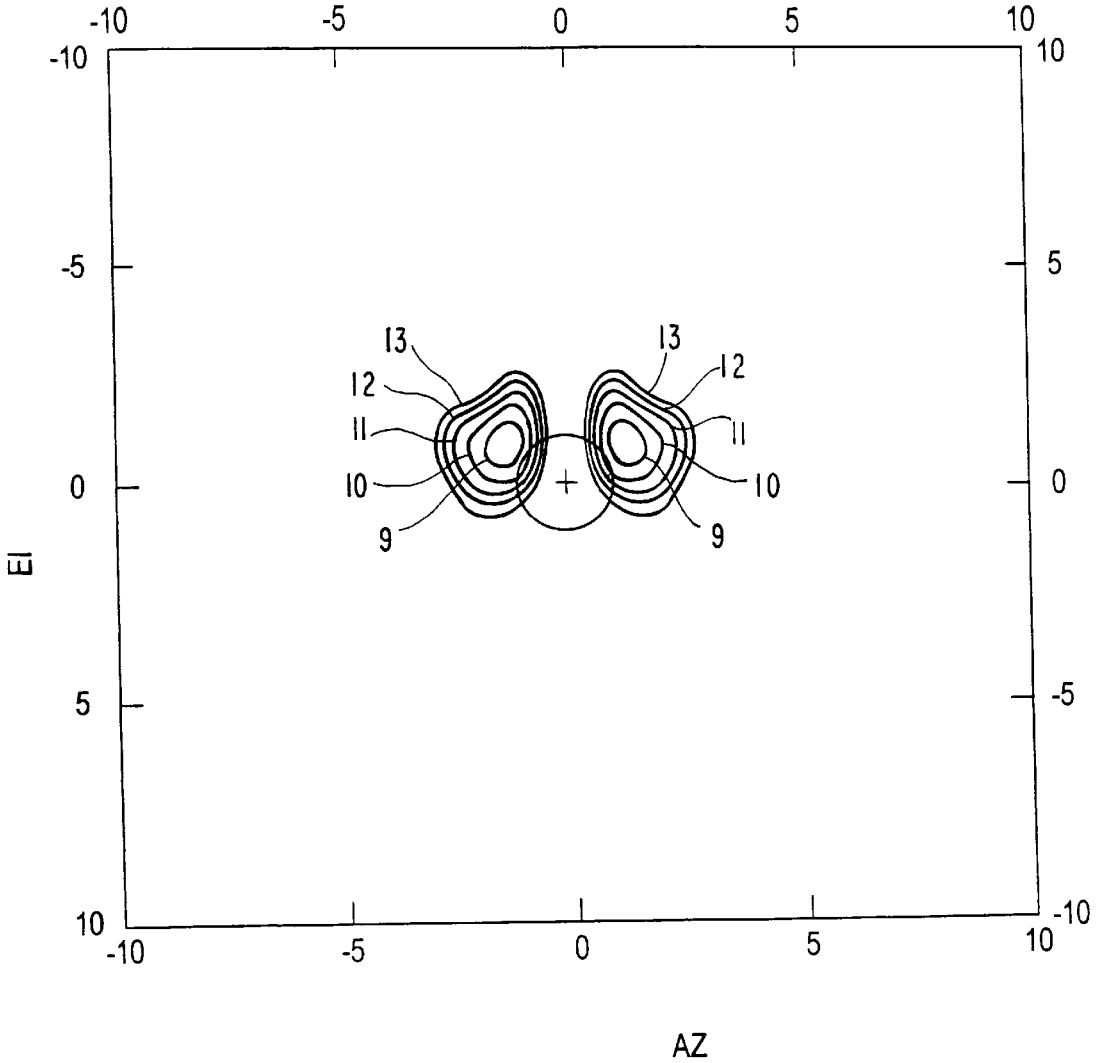
FIG. 21*b* shows a cross-polar radiation pattern of the antenna of FIG. 8 with the elliptically shaped sub-reflector rotated at an angle of 90° and the main reflector translated by −50 mm along axis 5.

An illustrative example of such reconfigurability is shown in the radiation patterns at secondary level of FIGS. 19, 20 and 21, obtained by translating the main reflector 3 of FIG. 8 along axis 5 by 50 mm, in the direction opposite to that previously used in section I(B), for three different orientations of sub-reflector 2 with respect to axis 4 at 0°, 45° and 90°, respectively. In particular, FIGS. 19*a*, 20*a* and 21*a* are radiation patterns of the co-polar components and the corresponding cross-polar values are shown in FIGS. 19*b*, 20*b* and 21*b*, respectively. These figures clearly show the capability of this movement to reconfigure the nominal elliptical beam continuously into an elliptical beam with a ratio of minor and major axes that is smaller than the initial value irrespective of the orientation of the elliptical beam. As an extreme case it is possible to obtain the circular beam denoted by the circle in FIGS. 19*a*, 20*a* and 21*a*.

II. EXAMPLE 2

Circular Beam Zoom

Figure 22A:
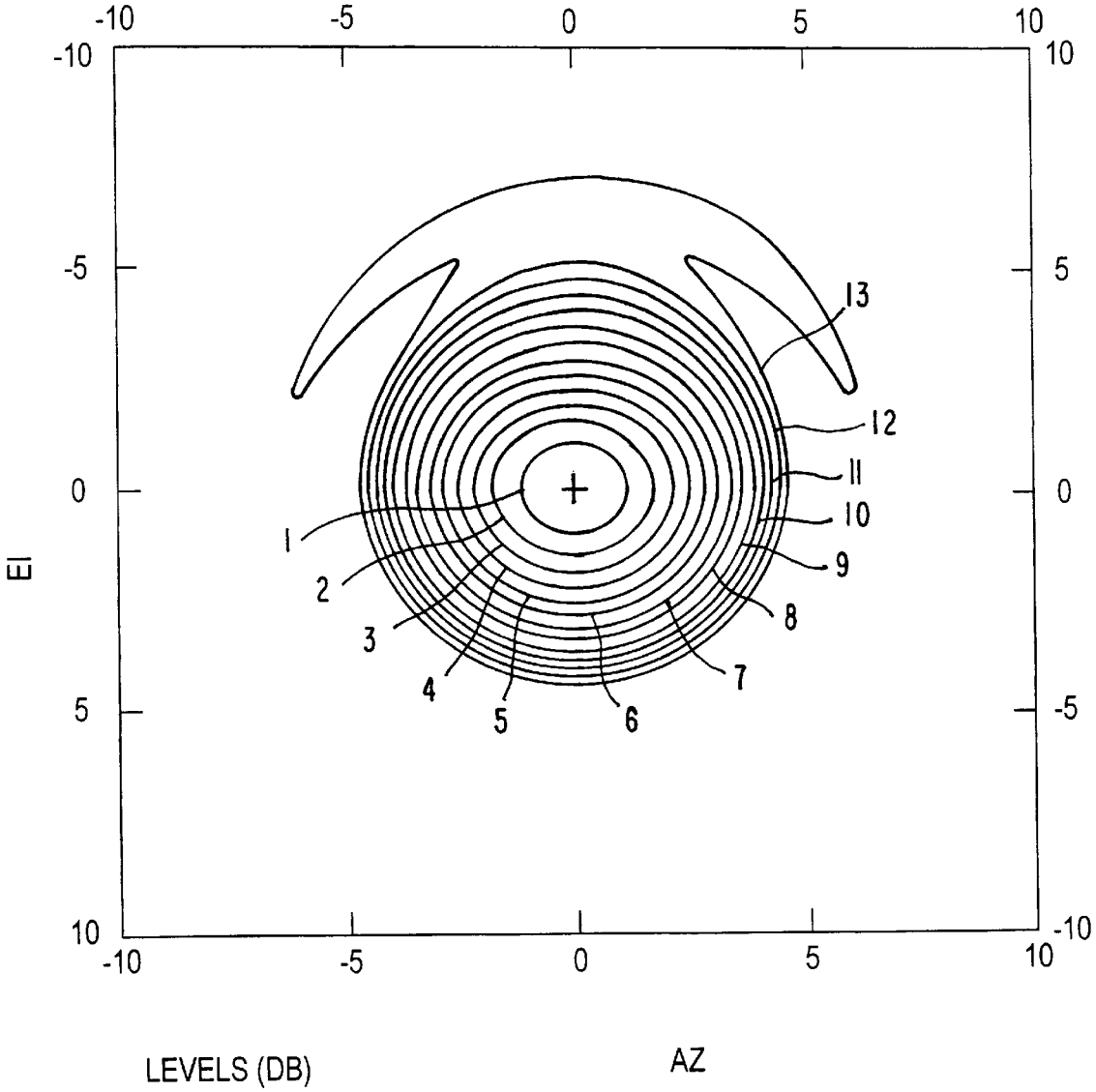
FIG. 22*a* shows a co-polar radiation pattern of the antenna of FIG. 8 with a rotational symmetric sub-reflector with respect to axis 4.
Figure 22B:
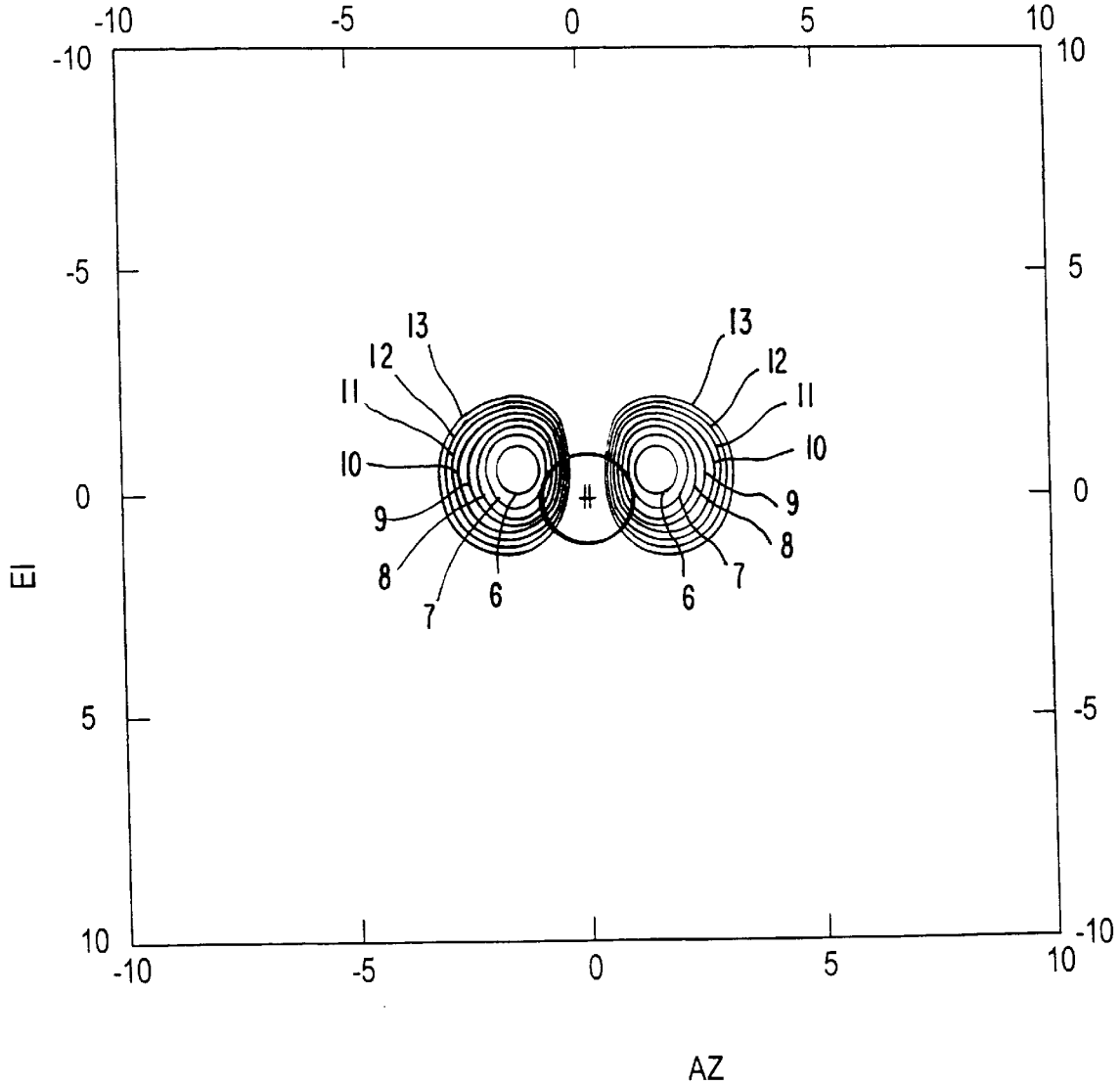
FIG. 22*b* shows a cross-polar radiation pattern of the antenna of FIG. 8 with a rotational symmetric sub-reflector with respect to axis 4.

The profile of sub-reflector 2 of FIG. 8 may be analytically modified to widen or zoom a circular beam through translation along axis 5 of the sub-reflector or main reflector. In this example, the parameters in the sub-reflector equation (1) are A=B=640 mm and C =570 mm. The initial radiation pattern is shown in FIG. 22. In particular, the co-polar radiation pattern is shown in FIG. 22*a* and the corresponding cross-polar values are shown in FIG. 22*b*, As seen in FIG. 22*a*, the co-polar beam is almost circular with a beam width at −3 dB of approximately 2°.

Figure 23A:
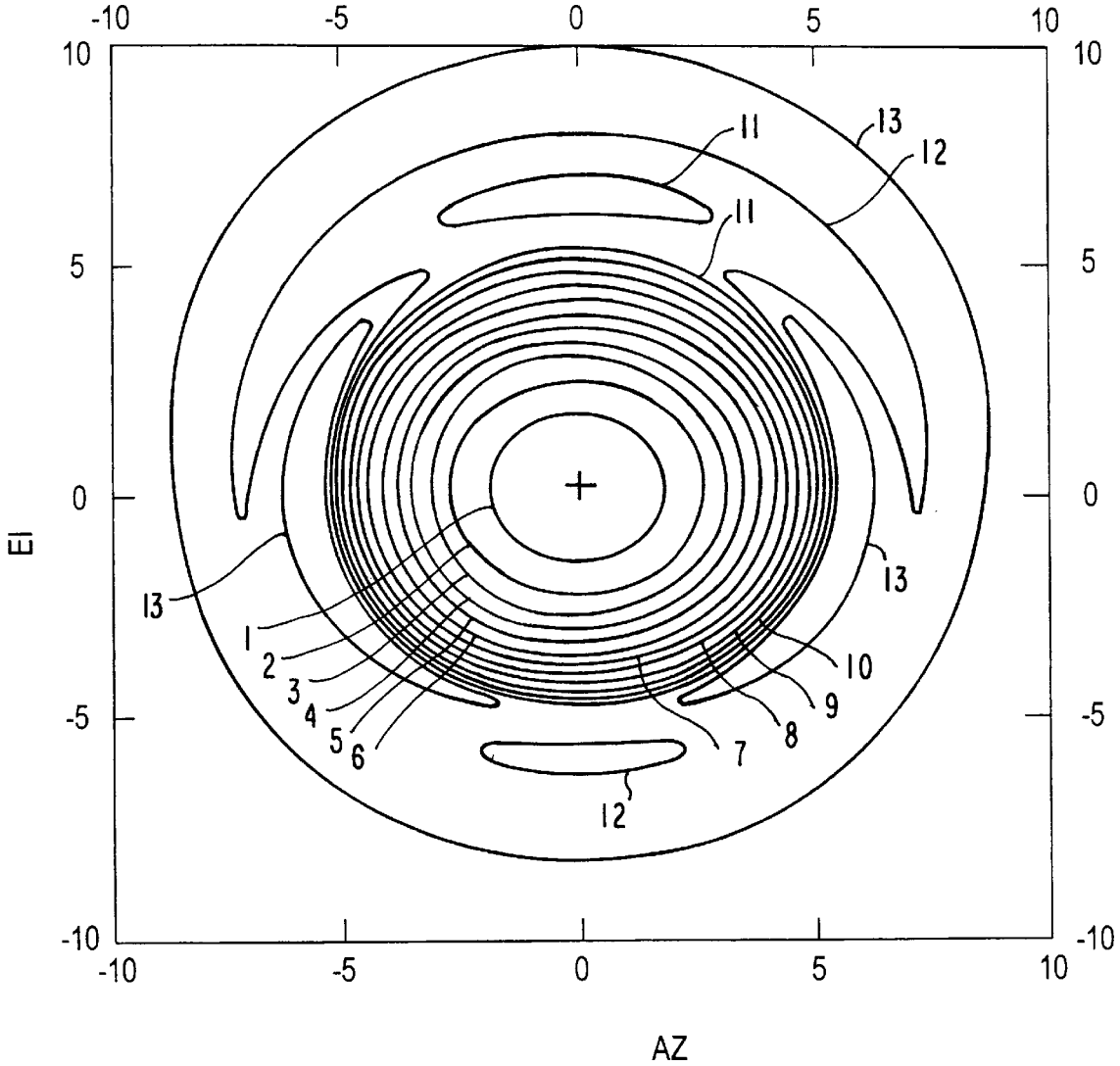
FIG. 23*a* shows a co-polar radiation pattern of the antenna of FIG. 8 with a rotational symmetric sub-reflector with respect to axis 4 and translation of the sub-reflector by 60 mm along axis 5 in the direction of main reflector 3.
Figure 23B:
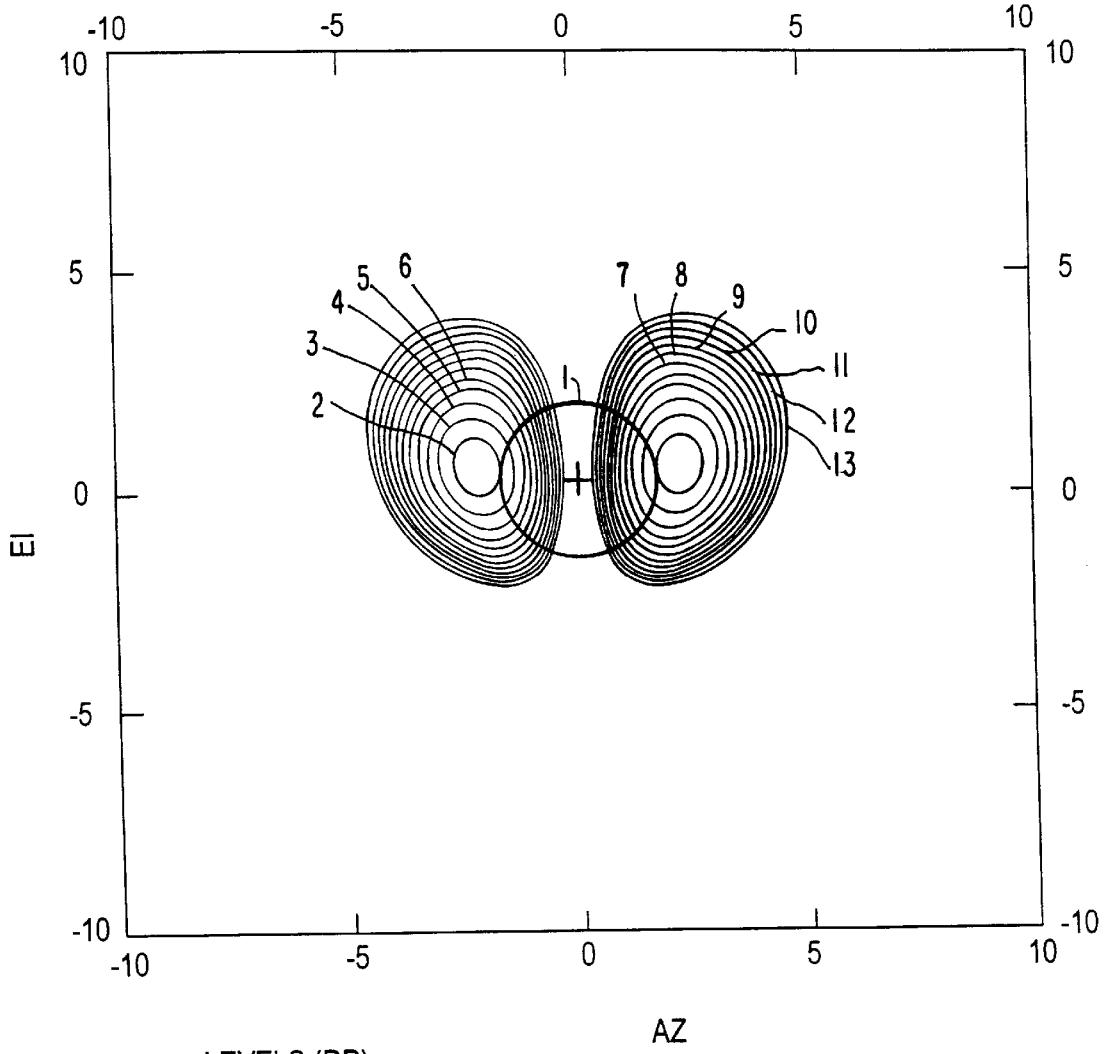
FIG. 23*b* shows a cross-polar radiation pattern of the antenna of FIG. 8 with a rotational symmetric sub-reflector with respect to axis 4 and translation of the sub-reflector by 60 mm along axis 5 in the direction of main reflector 3.

FIG. 23 shows the effect of translation of the sub-reflector 2 by 60 mm along axis 5 of FIG. 8, in the direction of main reflector 3. In particular, FIG. 23*a* depicts the co-polar radiation pattern and the corresponding cross-polar values are shown in FIG. 23*b*. As is evident from FIG. 23*a*, the co-polar radiation pattern has been widened to a beam width at −3 dB of 3.2°. The slightly elliptical contour may be improved by suitably optimizing the main reflector 3 of FIG. 8 or by numerically shaping the surface of the same reflector. In an alternate embodiment, a similar widening or zooming effect may be realized by translating main reflector 3 of FIG. 8 along axis 5 towards sub-reflector 2, instead of sub-reflector 2. The zoom function maintains extremely satisfactory radiation characteristics for both co-polar and cross-polar components and, as a result, the system may be used as an antenna on board a satellite with frequency re-use in an operational environment with more than one beam operating simultaneously. These examples are for illustrative purposes only and are not intended to limit the scope of the invention.

Figure 4:
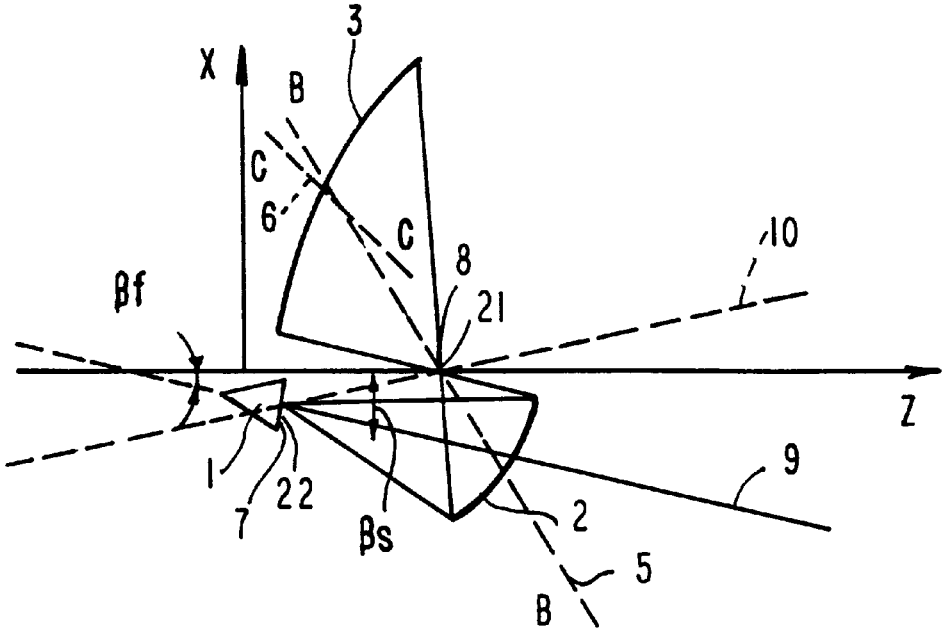
FIG. 4 depicts a schematic diagram of a classical Gregorian optical system which highlights the conditions for maximum polarization purity.

The zoom or widening function of the circular beam is compatible, with excellent performance, even with canonic Gregorian optics, the geometry of which has previously been described and shown in FIG. 4, as will now be discussed with reference to FIG. 24.

Figure 24:
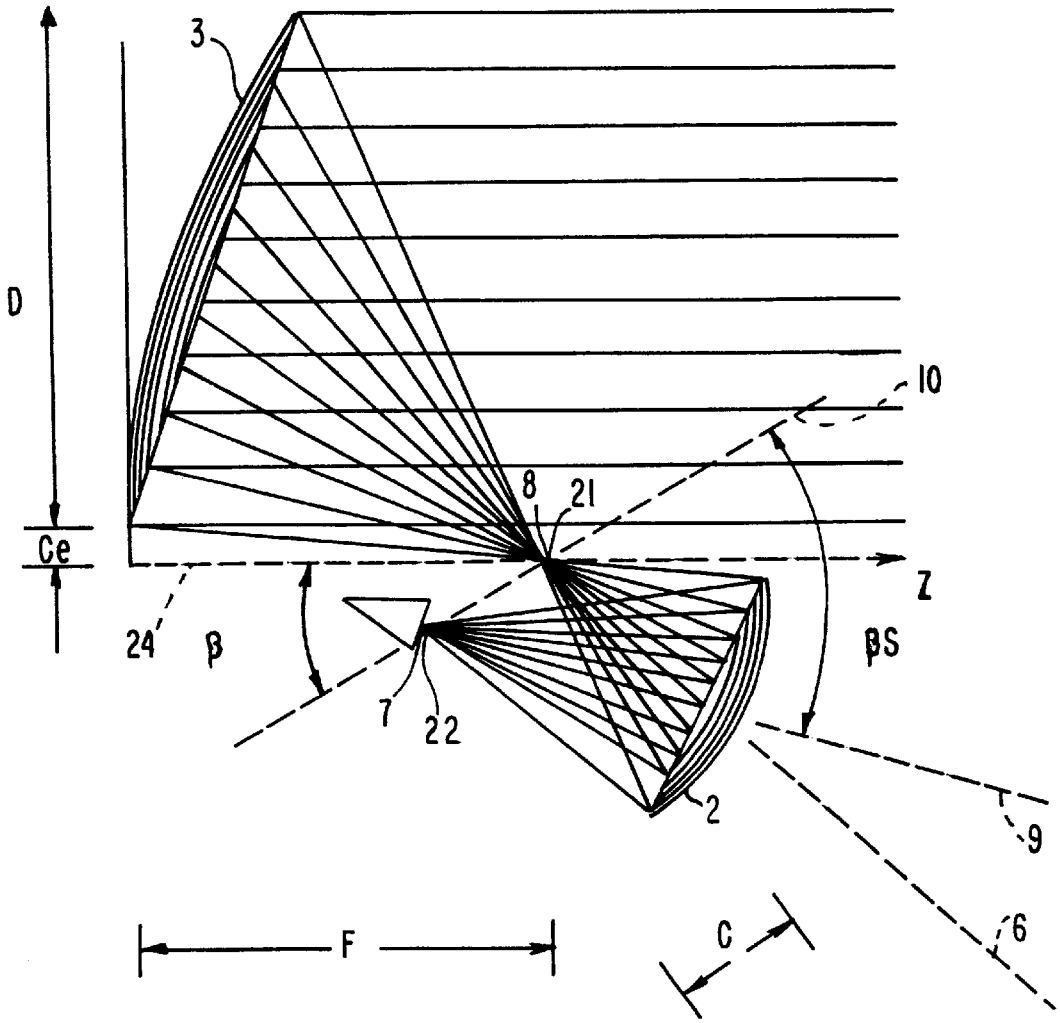
FIG. 24 depicts a schematic diagram of canonic Gregorian optics showing the geometric parameters for zoom of a circular beam.
Figure 25:
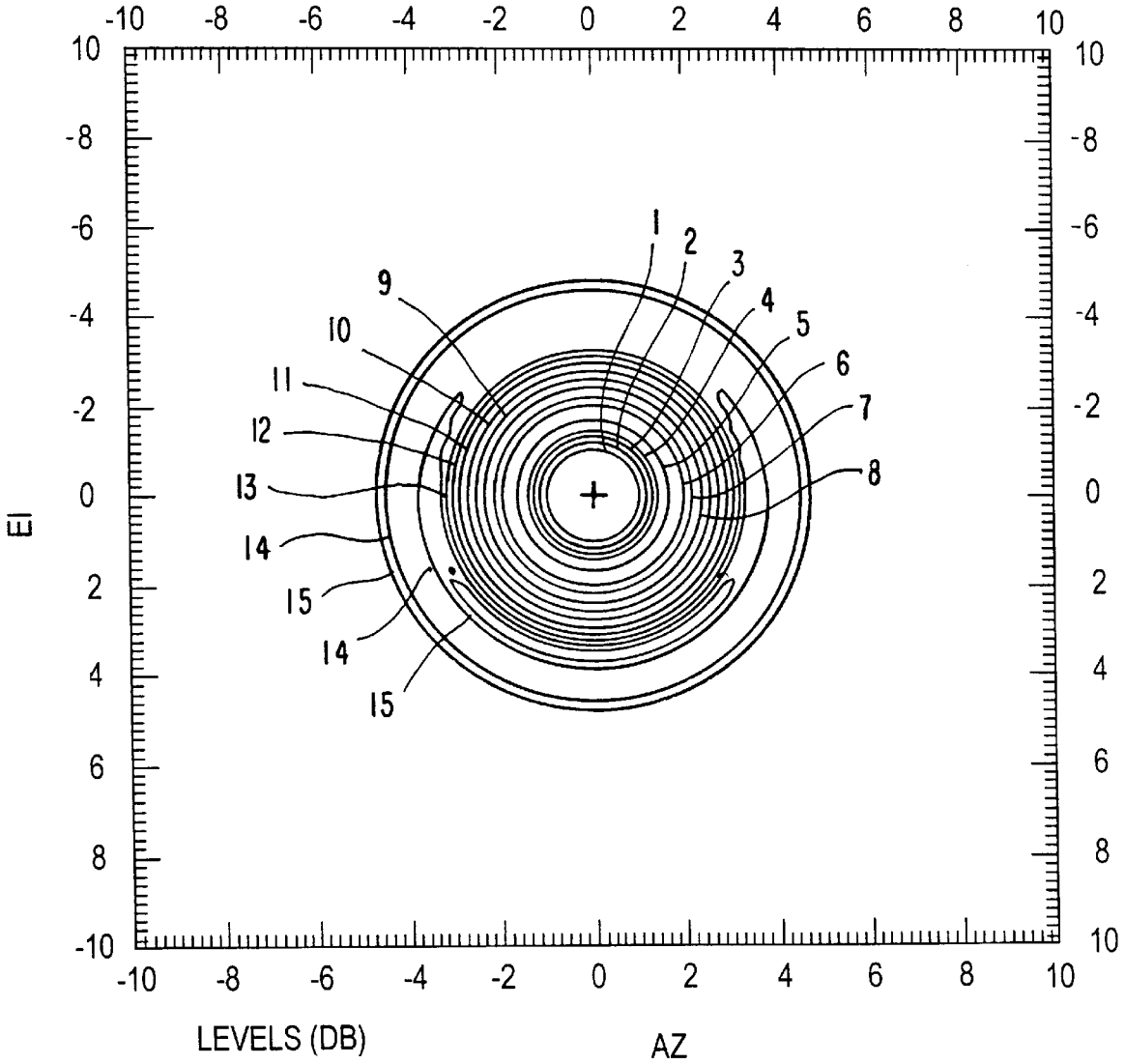
FIG. 25 shows a co-polar radiation pattern of the antenna of FIG. 24 with the main reflector and sub-reflector in their nominal position.
Figure 26:
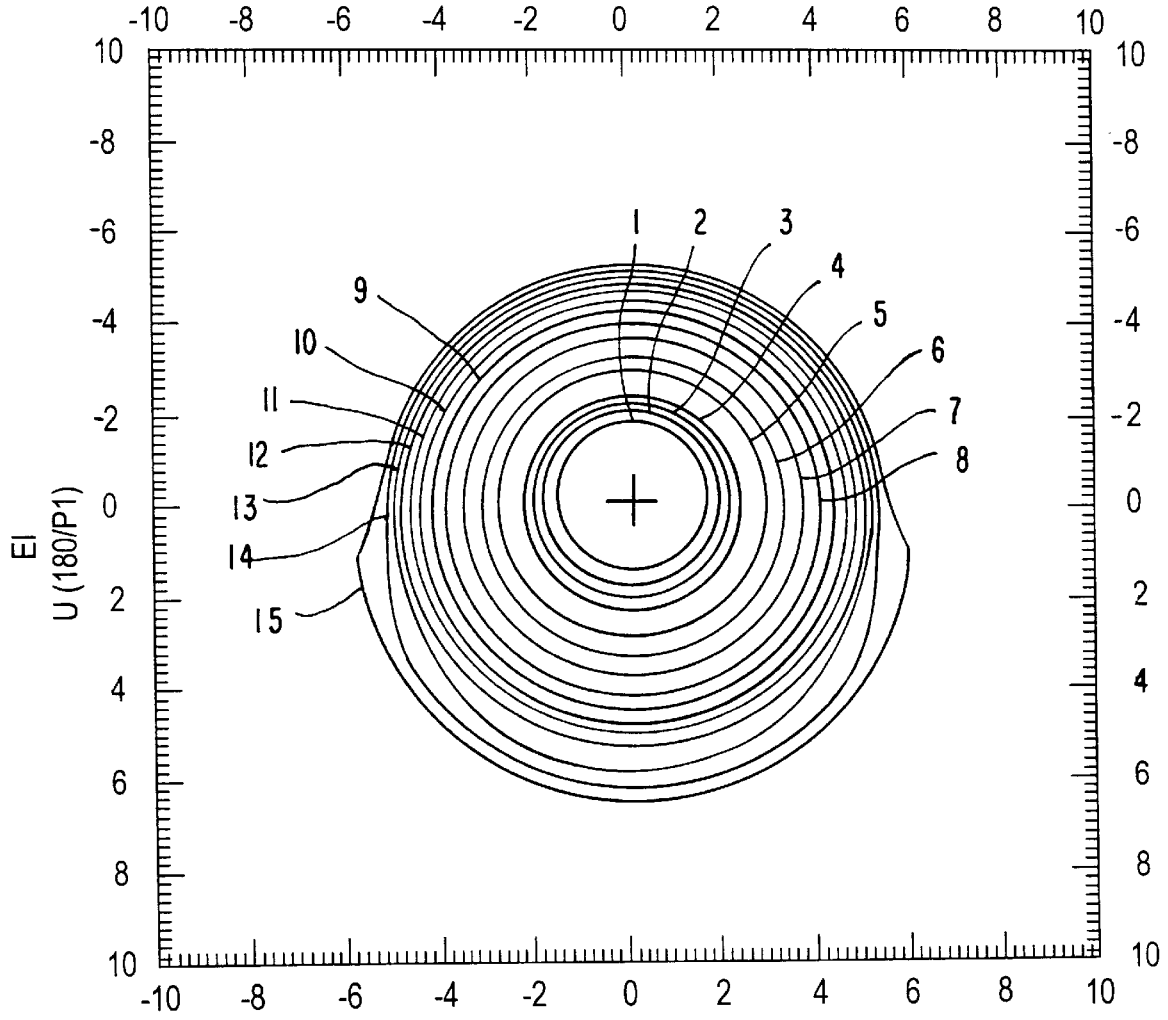
FIG. 26 shows a co-polar radiation pattern of the antenna of FIG. 24 with the main reflector translated by 128 mm along axis 6 towards the sub-reflector.

For purposes of illustrative example only, the widening function of a circular beam by a factor of 1.6:1 is described and shown through translation of the main reflector along axis 6 of FIG. 24. FIGS. 25 and 26 are co-polar diagrams showing the isolevels in dB related to the antenna peak. The nominal radiation pattern with the main and sub-reflectors in a normal position is shown in FIG. 25 with the beam width at −3 dB of 2°. FIG. 26 shows the beam widened to 3.2° at −3 dB. This widening of the beam is achieved by translating the main reflector by 128 mm along axis 6 in FIG. 24 towards the sub-reflector 2. Although the beam has been widened it maintains a substantially circular symmetry and very low sidelobes. The cross-polarization levels (not shown) in both cases are maintained at extremely low levels within the useful coverage area (−34 dB with respect to the local value of the co-polar), so that the system is suitable for use as an antenna on board satellites with frequency re-use. Although the zoom function is compatible with sub-reflector and main reflector translation, the latter is actually preferred because it better optimizes the electrical performance of the widened circular beam.

Figure 27A:
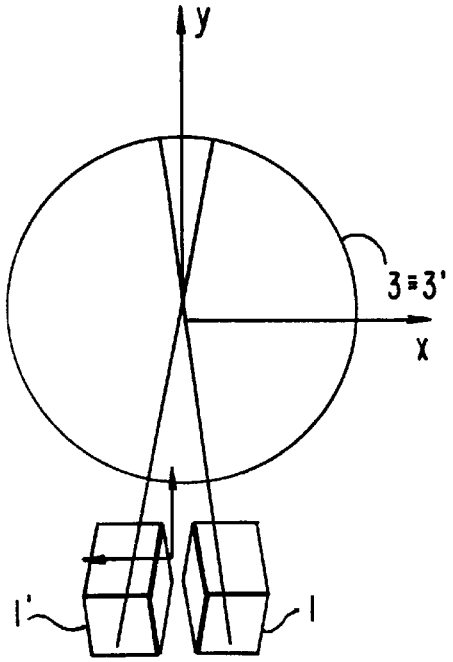
FIGS. 27*a*, 27*b* and 27*c* are schematic diagrams of a dual gridded reflector optic system.
Figure 27B:
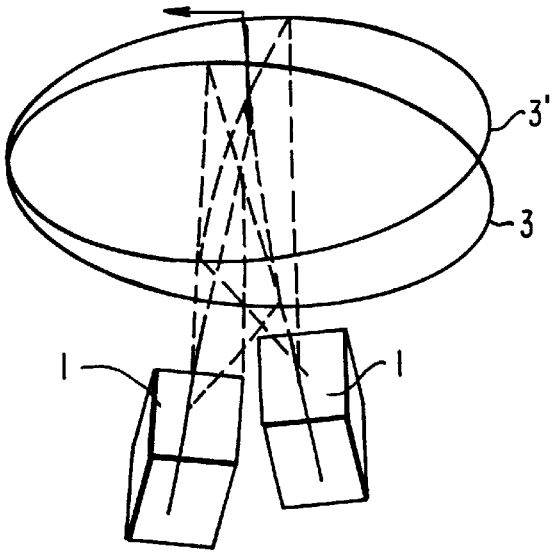
Figure 27C:
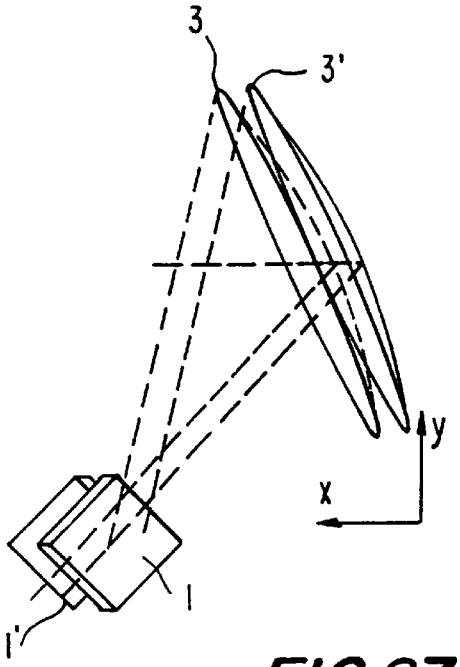
Figure 28A:
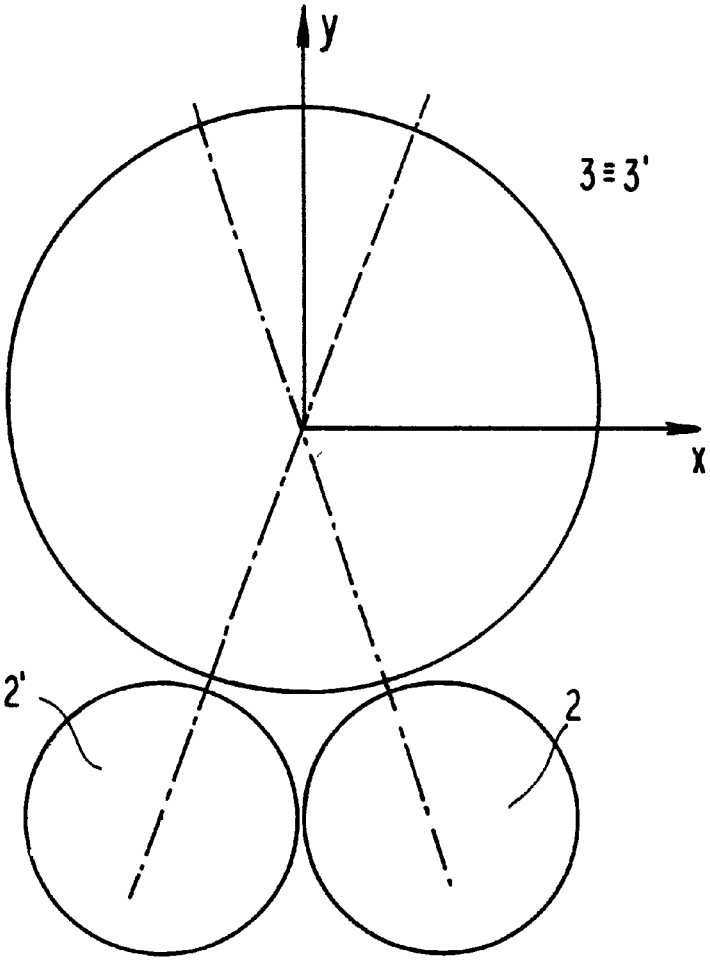
FIGS. 28*a*, 28*b* depict schematic diagrams of a Gregorian dual gridded reflector system capable of rotating the elliptical beam through simultaneous rotation of the two sub-reflectors.
Figure 28B:
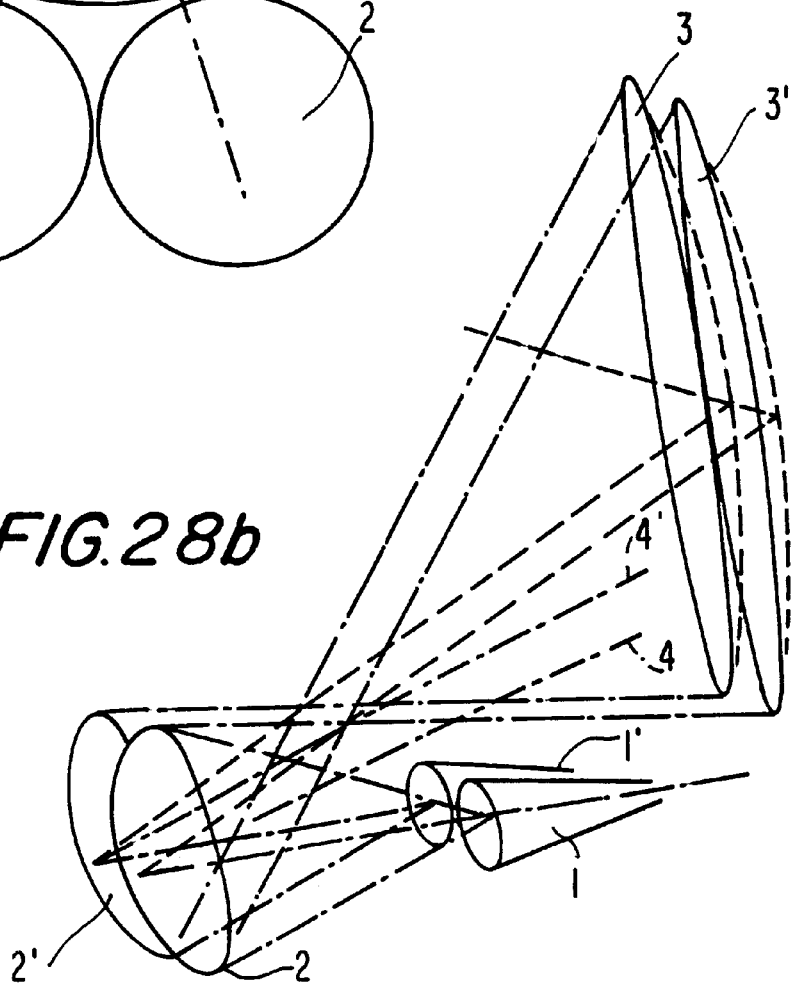
Figure 29:
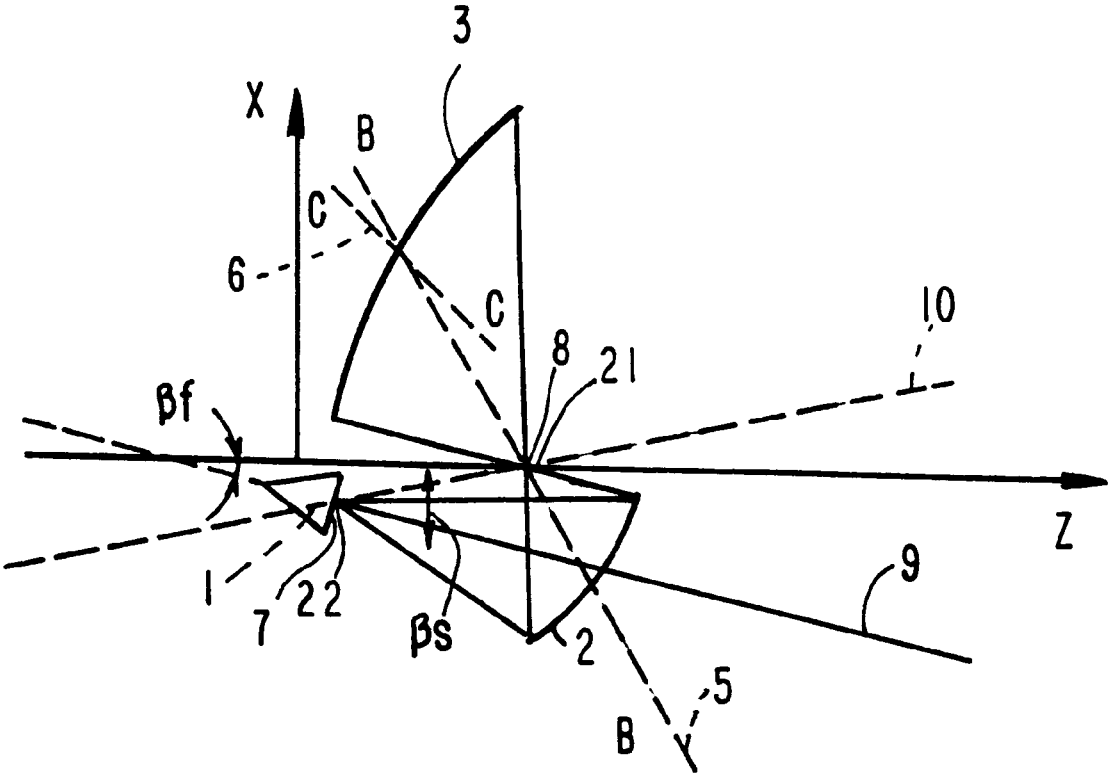
FIG. 29 shows a schematic diagram of a classical Gregorian optical system showing the degrees of freedom of translation of the sub-reflector and/or main reflector.

The rotation function of the elliptical beam is also suitable for use with other optics. In particular, the elliptical beam rotation function may for example be used with gridded optics, shown in FIG. 27, by simultaneously rotating two sub-reflectors as depicted in FIG. 28. The optic system of FIG. 28 includes a feed 1 related to X polarization, a feed 1' related to Y polarization, sub-reflector 2 related to feed 1, sub-reflector 2' related to feed 1', gridded main front reflector 3 which is sensitive to X polarization, and gridded or solid main rear reflector 3' related to Y polarization. Rotation of the elliptical beam with polarization along the X axis is effected by rotating sub-reflector 2 about rotation axis 4. Similarly, rotation of the elliptical beam with polarization along the Y axis is effected by rotating sub-reflector 2' about rotation axis 4'.

The criteria for implementation of the geometric system for each polarization are the same as hereinabove described. The principle of rotating the sub-reflector is applicable to any type of double gridded reflector. This optic system is advantageous in that (1) turnable elliptical coverages may be realized with typical polarization purity values for gridded reflectors that are far greater than those obtainable with solid reflector Gregorian antennas; and (2) two independent elliptical coverages with arbitrary orientation (one for X polarization and the other for Y polarization) may be achieved in a double linear polarization system.

The zooming of a circular or elliptical beam may also be applied to other types of optics. In particular, beam widening from circular-to-circular and from elliptical-to-elliptical, through translation of the main reflector or sub-reflector, is applicable to classical Gregorian optics with standard surfaces as shown in FIGS. 4 and 24.

The circular beam optics may include an ellipsoidal sub-reflector and a parabolic main reflector. Referring to FIG. 24, by translation of the sub-reflector or the main reflector along axis 6, a zoom function of a circular beam with excellent co-polar and cross-polar performance may be realized.

By modifying the profile of the main reflector analytically (bifocal parabolic reflector) or equivalently by numerical methods, the elliptical beam may be achieved using the antenna shown in FIG. 24. Zoom and/or reconfiguration of the elliptical beam may be effected by translation of sub-reflector 2 and/or main reflector 3 along axis 6 of FIG. 24.

Thus, the inventive antenna is capable of rotating an elliptical beam. In particular, through a simple rotation of the sub-reflector of an antenna of the Gregorian family, the radiation pattern may be rotated while substantially maintaining the orientation of the electrical field and the invariant shape of the beam during rotation. The methodology with which the optical system herein described is constructed and the shaping of the surfaces through which the rotation of the elliptical coverage pattern is accomplished is rotation of the surface of the sub-reflector. Rotation of the sub-reflector in this manner is currently not acheivable with conventional Gregorian antenna systems.

The inventive optical system may also be used to perform widening (zoom) and/or reconfigurability functions of the beam by translation of the sub-reflector or the main reflector along predetermined axes. In addition, the inventive configuration is virtually unlimited in the degrees of freedom of rotation and translation through which the elliptical beam may be rotated, zoomed or widened, irrespective of the orientation of the elliptical beam.

By translating the sub-reflector or the main reflector, either alone or in combination with rotation of the beam, the circular beam may be widened (zoomed) into another circular beam by a considerable factor, for example greater than or equal to 2:1. In addition, an elliptical beam may be widened (zoomed) into another elliptical beam. Moreover, the elliptical beam may be reconfigured into a circular beam with the diameter close to the minor axis of the elliptical beam or, alternatively, into an elliptical beam rotated by 90° with respect to the initial elliptical beam.

The inventive antenna is also advantageous in that a zoom function may be realized, without rotation of the beam, even when used with classical Gregorian type optics. In addition to Gregorian type optics, the inventive antenna is suitable for use with gridded optics in which two rotatable sub-reflectors may be rotated independently in order to rotate the elliptical beam.

A significant advantage is the compatibility of the functions previously mentioned with radiation electrical performance typical of antennas of the double offset reflector type such as the Gregorian family of antennas. The performance of such antennas may be summarized as producing relatively high efficiency of the beam and extremely low cross-polarization and sidelobe levels. As a result of these beneficial characteristics, the system may be used as an antenna on board a satellite with reutilization of polarization in an operational environment with one or more simultaneously active beams. The beam scan function is compatible with the antenna configuration described herein and may be implemented using known methods such as by rotation of the entire antenna with twin orthogonal axes motors or by independent rotation of only the main reflector around any selected point.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. A Gregorian, double-reflector, microwave antenna which produces an elliptical beam, comprising:

a feed;

a main reflector; and a sub-reflector having a shaped surface and two orthogonal symmetry planes that cross along a sub-reflector axis, said sub-reflector being rotatable about the sub-reflector axis so as to rotate the elliptical beam of the antenna while substantially maintaining orientation of an electrical field of the produced beam with substantially no cross-polarization, at least one of said main reflector being translatable along a main reflector translation axis and said sub-reflector being translatable along a sub-reflector translation axis for reconfiguring the produced beam of the antenna.

2. An antenna in accordance with claim 1, wherein at least one of said main reflector and said sub-reflector are translatable so as to widen the produced elliptical beam of the antenna.

3. An antenna in accordance with claim 1, wherein at least one of said main reflector and said sub-reflector are translatable so as to vary a ratio of major and minor axes of the produced elliptical beam.

4. An antenna in accordance with claim 1, wherein said main reflector comprises two polarization-selective reflectors and said sub-reflector comprises two reflectors, each having an associated feed.

5. A Gregorian, double-reflector, microwave antenna which produces an elliptical beam, comprising:

a feed;

a main reflector; and a sub-reflector rotatable about a sub-reflector axis;

wherein said main reflector is arranged for translation along a main reflector translation axis and said sub-reflector is rotatable so as to widen and reconfigure the beam of the antenna.

6. A method for rotating and reconfiguring an elliptical beam generated by a Gregorian, double reflector, microwave antenna having a feed, a sub-reflector and a main reflector, said method comprising the steps of:

rotating the sub-reflector about a sub-reflector rotation axis so as to rotate the elliptical beam of the antenna while substantially maintaining an orientation of an electrical field and shape of the beam with substantially no cross-polarization; and translating the main reflector along a main reflector translation axis so as to reconfigure the beam of the antenna.

7. A method in accordance with claim 6, wherein said translating step comprises widening the elliptical beam.

8. A method in accordance with claim 6, wherein said translating step comprises varying a ratio of major and minor axes of the elliptical beam.

9. A method in accordance with claim 6, wherein the main reflector comprises two polarization-selective reflectors and the sub-reflector comprises two reflectors, each sub-reflector having an associated feed.

* * * * *